US010526121B2

(12) United States Patent
Bellamah et al.

(10) Patent No.: US 10,526,121 B2
(45) **Date of Patent: *Jan. 7, 2020**

(54) RESEAL LABEL FOR BOX IN A BOX RE-SEALABLE PACK

(71) Applicant: Altria Client Services LLC, Richmond, VA (US)

(72) Inventors: Stephen Bellamah, Midlothian, VA (US); James S. Bigelow, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/148,558

(22) Filed: Oct. 1, 2018

(65) Prior Publication Data

US 2019/0031419 A1 Jan. 31, 2019

Related U.S. Application Data

(63) Continuation of application No. 15/668,822, filed on Aug. 4, 2017, now Pat. No. 10,086,987, which is a (Continued)

(51) Int. Cl.

| | |
|---|---|
| ***B65D 77/00*** | (2006.01) |
| ***B65D 85/10*** | (2006.01) |
| ***B65D 77/04*** | (2006.01) |
| ***B65D 75/00*** | (2006.01) |
| ***B65D 85/00*** | (2006.01) |
| ***B65D 75/68*** | (2006.01) |

(52) U.S. Cl.

CPC ..... *B65D 75/68* (2013.01); *B65D 77/003* (2013.01); *B65D 77/042* (2013.01); (Continued)

(58) Field of Classification Search

CPC ..... B65D 75/5894; B65D 85/10; B65D 85/1045; B65D 77/02; B65D 85/1036; (Continued)

(56) References Cited

U.S. PATENT DOCUMENTS

| | | | |
|---|---|---|---|
| 2,023,386 | A | 12/1935 | Geerlings |
| 3,606,139 | A | 9/1971 | Arscott |

(Continued)

FOREIGN PATENT DOCUMENTS

| | | | |
|---|---|---|---|
| EP | 3009374 | A1 | 4/2016 |
| WO | 2008142540 | A1 | 11/2008 |

(Continued)

OTHER PUBLICATIONS

International Search Report and Written Opinion dated Feb. 14, 2018 in corresponding International Patent Application No. PCT/US2017/056272, 12 pages.

(Continued)

*Primary Examiner* — Christopher R Demeree

(74) *Attorney, Agent, or Firm* — Buchanan Ingersoll & Rooney PC

(57) ABSTRACT

A container of consumer goods includes a rigid outer box and a rigid inner box wherein a pull tab is configured to reseal a pre-cut opening in the inner box. The pull tab includes a cover layer larger than the pre-cut opening. The cover layer can be a piece of bundle wrap with a paper layer of the bundle wrap contacting the consumer goods inside the box. The outer box has a hinged lid permanently attached to a connecting tab of the pull tab whereby opening the hinged lid simultaneously opens the pre-cut opening in the inner box by lifting the pull tab. The connecting tab includes adhesive which is partially deadened to decrease adhesion of the connecting tab to the inner box. The pull tab can also include one or more machine readable markings to enhance automated application of the pull tab to an inner box blank during manufacturing of the container.

30 Claims, 15 Drawing Sheets

Related U.S. Application Data continuation-in-part of application No. 15/446,789, filed on Mar. 1, 2017, now Pat. No. 10,077,132, which is a continuation-in-part of application No. 15/292,913, filed on Oct. 13, 2016, now Pat. No. 10,124,953.

(52) U.S. Cl.
CPC ..... *B65D 85/1027* (2013.01); *B65D 85/1045* (2013.01); *B65D 75/00* (2013.01); *B65D 85/00* (2013.01)

(58) Field of Classification Search
CPC .. B65D 5/543; B65D 5/5485; B65D 75/5855; B65D 75/68; B65D 77/003; B65D 85/1018; A24F 15/00
USPC ..... 229/120, 160.1, 203; 206/259, 268, 273, 206/265, 271, 274, 245, 774
See application file for complete search history.

(56) References Cited

U.S. PATENT DOCUMENTS 3,996,945 A 12/1976 McDowell
4,293,068 A 10/1981 Focke et al.
4,300,676 A 11/1981 Focke et al.
4,375,260 A * 3/1983 Focke ..... B65D 85/1045 206/264
4,555,027 A 11/1985 Froom
4,607,748 A * 8/1986 Focke ..... B65D 77/02 206/254
4,712,689 A 12/1987 Froom
4,763,779 A * 8/1988 Focke ..... B65D 77/02 131/329
4,771,882 A * 9/1988 Lowe ..... B65B 19/20 206/268
4,942,961 A 7/1990 Focke et al.
5,018,625 A * 5/1991 Focke ..... B65D 75/5838 206/494
5,022,950 A 6/1991 Ingalls et al.
5,080,227 A * 1/1992 Focke ..... B65D 5/38 206/273
5,096,113 A * 3/1992 Focke ..... B65B 61/18 229/160.2
5,158,664 A * 10/1992 Colgan ..... B65D 85/1045 206/242
5,788,065 A * 8/1998 Focke ..... B65D 85/10 206/268
5,914,165 A * 6/1999 Freedman ..... B32B 7/06 428/40.1
6,000,539 A 12/1999 Stewart-Cox et al.
6,132,349 A 10/2000 Yokoyama
6,164,444 A 12/2000 Bray et al.
6,237,760 B1 5/2001 Parker et al.
6,478,149 B1 11/2002 Parker
6,481,259 B1 11/2002 Durney
6,505,735 B1 1/2003 Parker
6,606,840 B2 8/2003 Focke et al.
6,736,262 B2 * 5/2004 Focke ..... B65D 85/1081 206/268
6,874,623 B2 4/2005 Bray
6,877,349 B2 4/2005 Durney et al.
6,974,406 B2 12/2005 Antonacci
7,533,773 B2 5/2009 Aldridge et al.
7,827,769 B2 * 11/2010 Bertuzzi ..... B65B 19/20 206/271
7,862,869 B2 1/2011 Papenfuss et al.
8,091,703 B2 1/2012 Marchetti et al.
8,123,030 B2 2/2012 Hein
8,276,750 B2 10/2012 Biondi et al.
8,418,845 B2 4/2013 Tawada et al.
8,474,612 B2 7/2013 Bertuzzi et al.
8,556,072 B2 10/2013 Bertuzzi et al.
8,590,701 B2 11/2013 Bertuzzi et al.
8,671,648 B2 3/2014 Bertuzzi et al.
8,783,454 B2 * 7/2014 Igo ..... B65D 75/5838 206/242
8,827,145 B2 * 9/2014 Hultberg ..... B65D 5/0227 229/200
9,033,141 B2 5/2015 Ghini et al.
9,089,165 B2 7/2015 Bertuzzi et al.
9,254,938 B2 * 2/2016 Iwata ..... B65D 5/662
9,359,124 B2 6/2016 Lutzig
9,382,062 B2 7/2016 Mitten et al.
9,499,331 B2 * 11/2016 Seyfferth De Oliveira ..... B65D 85/1045
9,533,821 B2 1/2017 Buse
9,714,134 B2 * 7/2017 Tacchi ..... B65D 85/1036
10,053,273 B2 8/2018 Petrucci et al.
2005/0041889 A1 2/2005 Scarberry
2005/0130822 A1 * 6/2005 Rath ..... B65D 75/5827 493/309
2006/0011504 A1 * 1/2006 Gosebruch ..... G06K 17/00 206/459.5
2006/0011540 A1 1/2006 Pressley et al.
2006/0021883 A1 2/2006 Focke et al.
2006/0037876 A1 * 2/2006 Fath ..... B65B 19/14 206/271
2006/0231431 A1 * 10/2006 Tambo ..... B65D 5/5485 206/268
2008/0230410 A1 9/2008 Jones et al.
2009/0071852 A1 * 3/2009 Negrini ..... B65D 85/10 206/268
2009/0184158 A1 * 7/2009 Lutzig ..... B65D 85/1045 229/160.1
2009/0188818 A1 * 7/2009 Moore ..... B65D 5/662 206/268
2009/0308766 A1 12/2009 Polloni et al.
2010/0163563 A1 7/2010 Lutzig
2011/0114518 A1 5/2011 Hein
2011/0180432 A1 7/2011 Blick et al.
2012/0111746 A1 5/2012 Tanbo et al.
2012/0177307 A1 7/2012 Duan et al.
2012/0241339 A1 * 9/2012 Buse ..... B65B 19/20 206/268
2012/0291401 A1 11/2012 Mitten et al.
2014/0054300 A1 2/2014 Gilpatrick et al.
2014/0079343 A1 3/2014 Lyzenga et al.
2014/0110286 A1 4/2014 Bertuzzi et al.
2014/0374290 A1 12/2014 Seyfferth de Oliveira
2015/0021219 A1 1/2015 Seyfferth de Oliveira
2015/0034509 A1 2/2015 Seyfferth de Oliveira
2015/0041346 A1 2/2015 Seyfferth de Oliveira
2015/0320111 A1 11/2015 Slooff
2015/0375923 A1 12/2015 Pilzecker
2016/0236855 A1 8/2016 Chatelain et al.
2016/0368645 A1 12/2016 Buse
2017/0036849 A1 2/2017 Mitten et al.
2017/0152100 A1 6/2017 Polloni et al.
2017/0334634 A1 11/2017 Bray et al.
2017/0341852 A1 11/2017 Bray et al.

FOREIGN PATENT DOCUMENTS

WO 2013120916 A1 8/2013
WO 2014195008 A2 12/2014
WO 2015181522 A1 12/2015
WO 2016059077 A1 4/2016
WO 2016087819 A1 6/2016
WO 2016102461 A1 6/2016
WO 2017002002 A1 1/2017
WO 2018024375 A1 2/2018

OTHER PUBLICATIONS

International Search Report and Written Opinion dated Apr. 23, 2018 in corresponding International Patent Application No. PCT/US2018/020127, 12 pages.
Extended European Search Report dated Apr. 12, 2018 in corresponding European Patent Application No. 17196271.5-1016, 9 pages.

(56) References Cited

OTHER PUBLICATIONS

Third Party Observation dated Nov. 16, 2018 in corresponding International Patent Application No. PCT/US2018/020127, 4 pages.
Third Party Observation dated Oct. 11, 2019 in corresponding European Patent Application No. 17860004.5, 3 pages.
Extended European Search Report dated Aug. 19, 2019 in corresponding European Patent Application No. 17860004.5, 10 pages.

* cited by examiner

RESEAL LABEL FOR BOX IN A BOX RE-SEALABLE PACK

FIELD

This application is a continuation of U.S. patent application Ser. No. 15/668,822, which is a continuation-in-part of U.S. patent application Ser. No. 15/446,789, filed Mar. 1, 2017, issued as U.S. Pat. No. 10,077,132 on Sep. 18, 2018, which is a continuation-in-part of U.S. patent application Ser. No. 15/292,913, filed Oct. 13, 2016, the entire content of each of which is incorporated herein by reference. The present disclosure relates to a package for consumer goods and particularly to a re-sealable cigarette pack.

BACKGROUND

Various approaches have been made for packaging consumer goods. In the case of cigarettes, for example, packages are designed to preserve the flavor and also protect the goods from contamination. Known packages employ outer containers having a hinged lid providing access to an inner container with an opening for accessing the consumer goods. The outer containers are generally formed of a rigid paperboard, cardboard, or other suitable material. The inner container is generally formed of a material or combination of materials having substantially less rigidity than the outer container. For example, the inner container is known to be formed of paperboard, packing material, paper, and/or aluminium. In known designs, a label with a tacky substance for sealing and re-sealing can be used to cover the opening of the inner container.

SUMMARY

In an embodiment, a pull tab is provided for resealing an opening in a rigid inner box for consumer goods, wherein the inner box fits within a rigid outer box having a hinged lid configured to provide access to an inner volume of the outer box and the rigid inner box has a front wall, a back wall, a top wall, a bottom wall and side walls, a single opening extending across the top wall and part way down the front wall, the opening configured to provide access to consumer goods in an inner volume of the inner box. The pull tab comprises a rectangular sheet of polymer material including a zone of re-stick adhesive on an underside thereof, the re-stick adhesive configured to provide a seal around the opening when the hinged lid is closed and allowing the pull tab to be peeled away from the inner box when the hinged lid is opened. A paper liner is adhered to a central portion of the pull tab, the paper liner having an outer periphery inwardly of an outer periphery of the pull tab, the outer periphery of the paper liner extending beyond the opening and overlying portions of the inner box surrounding the opening when the hinged lid is closed; and a line of weakening forming a connecting tab at a lower end of the rectangular sheet of polymer material, the re-stick adhesive covering the connecting tab and deadened in at least one region of the connecting tab to promote peeling of the pull tab from the inner box.

The pull tab can include various features such as (a) a zone of permanent adhesive on an upper portion of the pull tab, the zone of permanent adhesive separated from the zone of re-stick adhesive by a gap free of adhesive, (b) a further line of weakening extending through the zone of permanent adhesive, (c) one or more machine readable markings on an inner surface and/or outer surface, (d) re-stick adhesive in a single zone and permanent adhesive in first and second zones, the first zone located at an upper portion of an inner surface of the pull tab and the second zone located at a lower portion of an outer surface of the pull tab, and/or (e) an adhesive-free border which extends completely around the inner surface of the pull tab, the adhesive-free border extending no more than about 2 mm from the outer periphery of the pull tab and/or the pull tab includes at least one machine readable marking on an outer surface thereof. In an embodiment, the single zone of re-stick adhesive includes an upper border parallel to the upper edge of the pull tab, side borders parallel to the side edges of the pull tab, and a lower border which provides a decreasing area of re-stick adhesive in a direction towards the lower edge of the pull tab and/or the first zone of permanent adhesive and the single zone of re-stick adhesive are separated by an adhesive-free gap extending completely across the pull tab to the adhesive-free border on opposite sides of the pull tab.

The pull tab can include a rectilinear line of weakening extending across the strip at a predetermined distance from the lower edge of the strip, a portion of the strip below the line of weakening forming a rectangular connecting tab. The strip can have parallel upper and lower edges and parallel side edges, wherein the side edges have a length greater than a width of the upper and lower edges, the upper zone of permanent adhesive has a rectangular shape extending about 30% of the length of the pull tab, and the lower zone of re-stick adhesive has a substantially rectangular shape extending about 70% of the length of the pull tab.

In another embodiment, a re-sealable pack includes a pull tab for resealing an opening in an inner box wherein the pull tab comprises a rectangular strip of flexible polymer material, an upper zone of permanent adhesive on a first side of the strip, the upper zone extending downwardly from an upper edge of the strip, a lower zone of re-stick adhesive on the first side of the strip, the lower zone extending upwardly from a lower edge of the strip and separated from the upper zone by an adhesive-free gap, a paper liner adhered via the re-stick adhesive to a central portion on the first side of the strip, the paper liner having an outer periphery separated from an outer periphery of the strip by re-stick adhesive on three sides of the paper strip and permanent adhesive on a fourth side of the paper liner; and at least one eyemark configured for application timing during automated placement of the pull tab on the inner box.

BRIEF DESCRIPTION OF THE DRAWING FIGURES

FIG. 1 illustrates an exploded view of a container for consumer goods in accordance with an exemplary embodiment of the present disclosure.

FIGS. 2A-B illustrate perspective views of a layer structure of the container in accordance with an exemplary embodiment of the present disclosure.

FIGS. 3A-C illustrate a first pull tab of the container in accordance with an exemplary embodiment of the present disclosure.

FIGS. 4A-C illustrate a second pull tab of the container in accordance with an exemplary embodiment of the present disclosure.

Figure 7A:
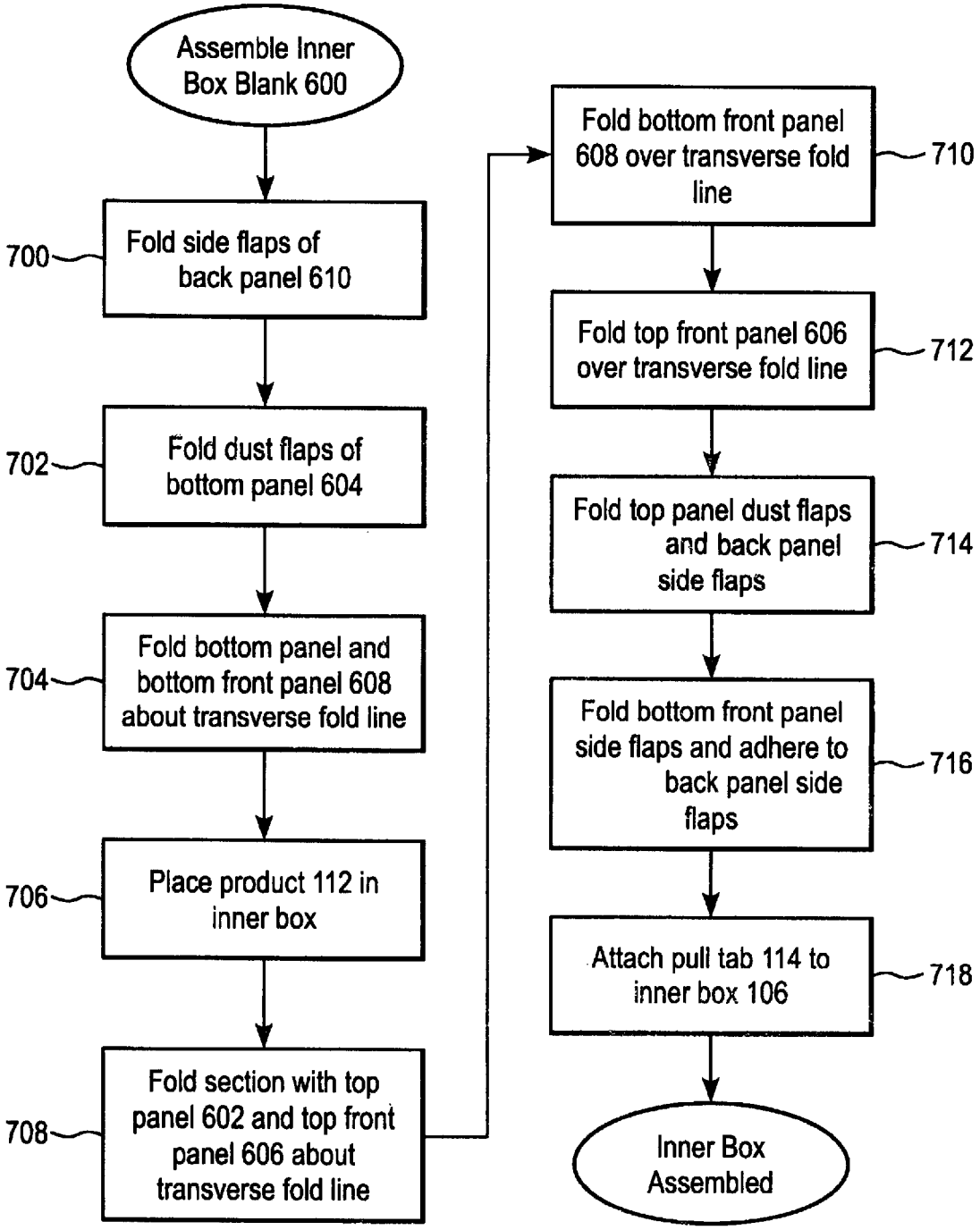
Figure 7B:
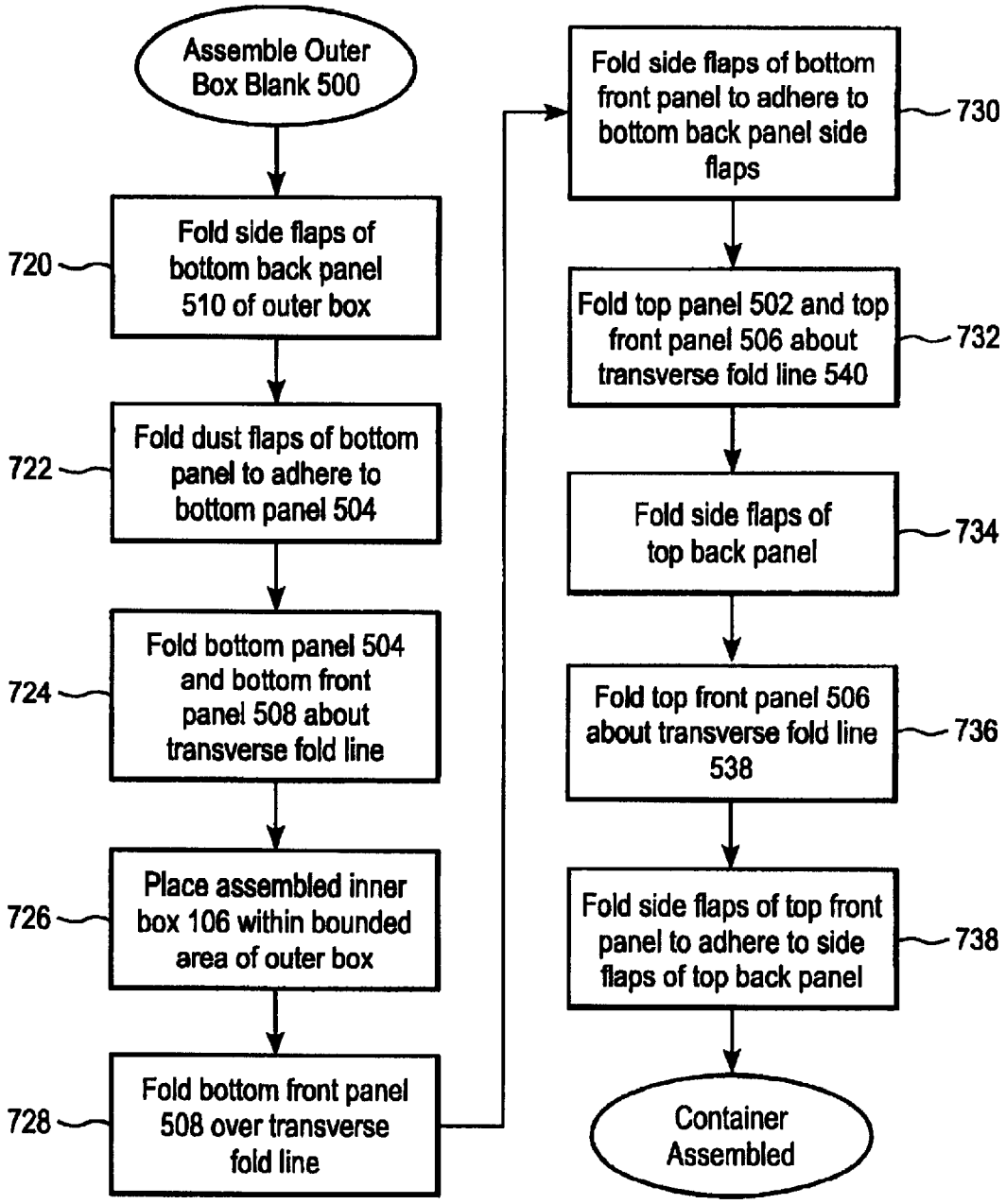

FIGS. 7A-B is a flow chart of a process for assembling the container in accordance with an exemplary embodiment of the present disclosure.

Figure 8:
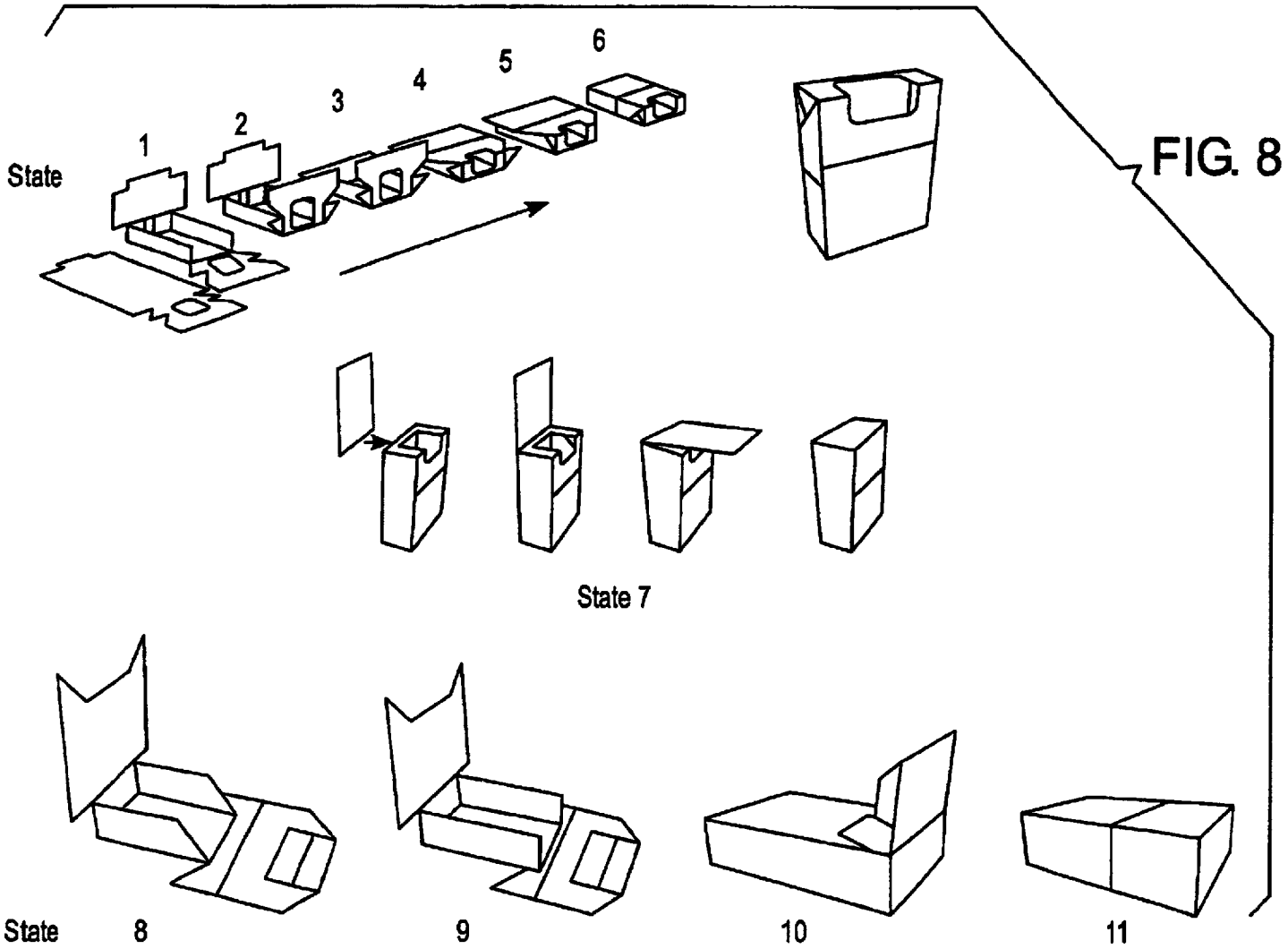

FIG. 8 illustrates a sequence of assembly states of the container according to the assembly process of FIGS. 7A-B.

Figure 9A:
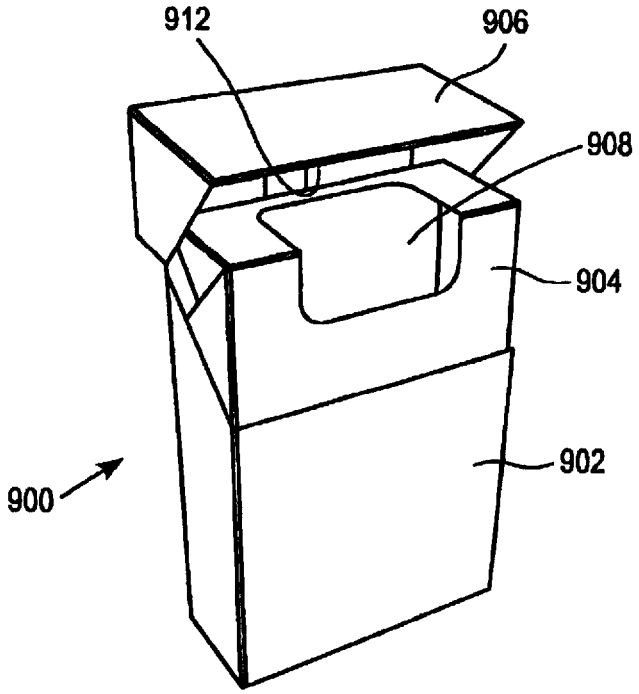
Figure 9B:
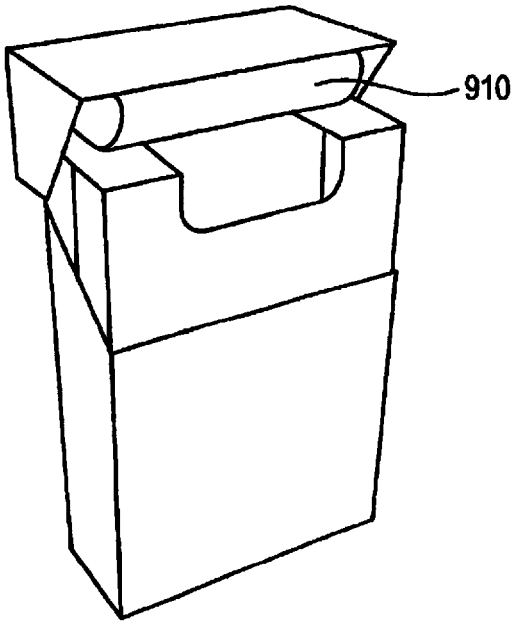

FIGS. 9A-B illustrate an assembled container in accordance with an exemplary embodiment of the present disclosure.

Figure 10A:
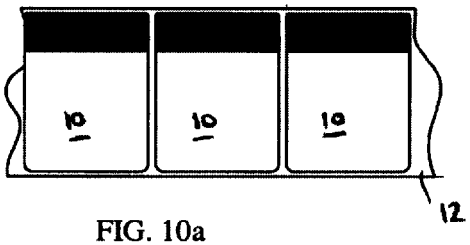
Figure 10B:
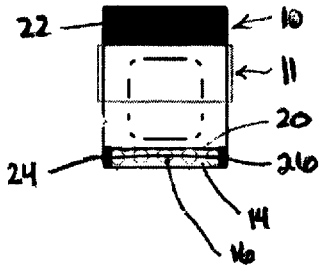
Figure 10C:
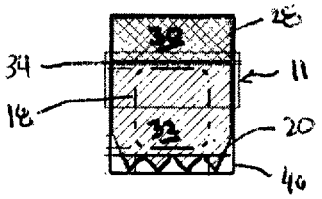
Figure 10D:
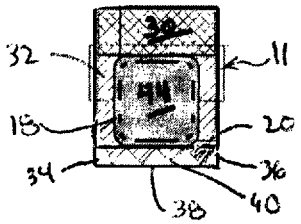
Figure 10E:
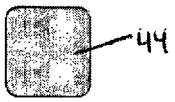

FIGS. 10A-E show details of a pull tab in accordance with an embodiment wherein FIG. 10A shows a succession of pull tabs on a backing strip, FIG. 10B shows an outer side of the pull tab with dots of permanent adhesive, FIG. 10C shows an underside of the pull tab with zones of permanent adhesive and re-stick adhesive, FIG. 10D shows an underside of the pull tab with a piece of foil/paper at a location which overlies an extraction opening in the inner box, and FIG. 10E shows a piece of the foil/paper which is adhered to the underside of the pull tab.

FIGS. 11A-H show details of the pull tab with areas of the restick adhesive deadened to allow easier peeling of the pull tab from the inner box.

Figure 12:
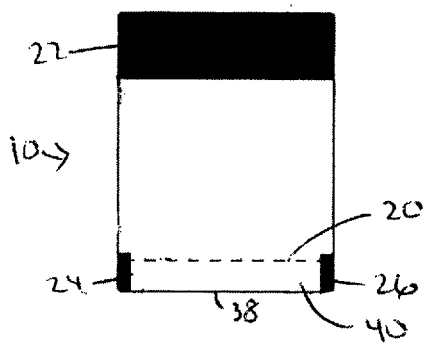

FIG. 12 shows details of a pull tab having three machine readable markings on an outer surface thereof.

Figure 13:
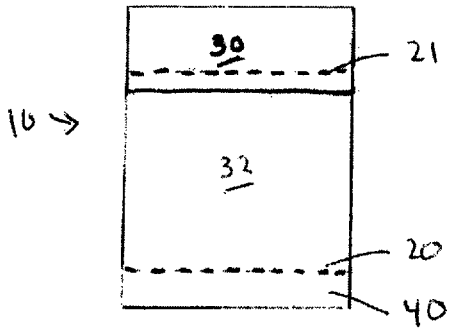

FIG. 13 shows details of a pull tab having an upper line of weakness to align with a corner of the inner box between the back wall and the top wall of the inner box.

Figure 14:
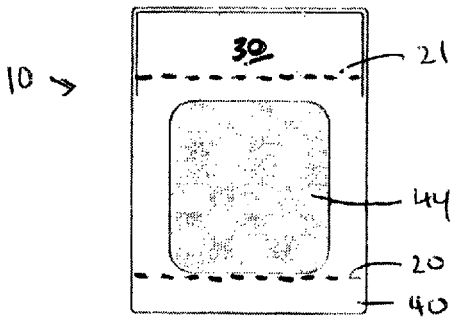

FIG. 14 shows a liner applied to the inner surface of the pull tab shown in FIG. 13.

DETAILED DESCRIPTION

Reference will now be made in detail to the various embodiments, one or more examples of which are illustrated in each figure. Each example is provided by way of explanation and is not meant as a limitation. For example, features and/or method steps illustrated or described as part of one embodiment and/or method can be used on or in conjunction with other exemplary embodiments and/or method steps to yield yet further exemplary embodiments or methods. It is intended that the present disclosure includes such modifications and variations.

Exemplary embodiments of the present disclosure are directed to a container for consumer goods having rigid inner and outer boxes. The outer box has a hinged lid that opens and closes to allow access the inner box. The inner box has an opening for accessing the consumer goods. The opening is covered by a re-sealable pull tab. An inner surface of the hinged lid being arranged to rotate about a fold line based on a tension force applied to the inner surface via the pull tab when the hinged lid is opened and closed. The inner box also has an inner liner including at least a layer of paper or other suitable material as desired. According to an exemplary embodiment the re-sealable pull tab has one or more layers where an innermost layer is composed of foil, paper, bundle wrap, or any combination thereof as desired. According to another exemplary embodiment the re-sealable pull tab includes at least one vent that allows air trapped under the releasable pull tab to escape when the inner box is sealed or re-sealed. The pull tab can be permanently connected to the inner box and the inner surface of the hinged lid. The exemplary container described herein provides several advantages such as an improved barrier and a simplified opening process designed to eliminate waste and one or more package opening steps. The arrangement of the re-sealable pull tab prevents spillage of the product when the package is accessed the first time. The container of the present disclosure also provides a more durable package by protecting the product from physical damage while the product is in use and a less expensive packaging solution as fewer pieces of equipment are needed to make the package. Moreover, the package assembly can be performed faster and with fewer material components over known re-sealable packaging designs.

Figure 1:
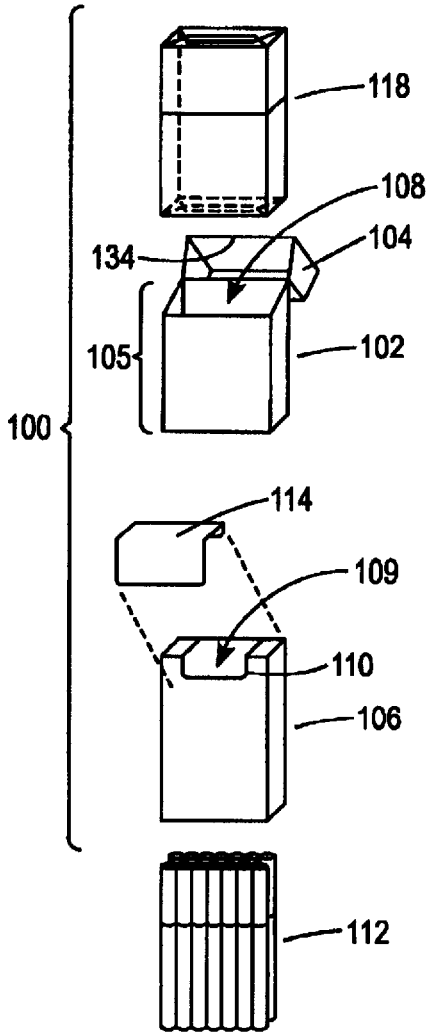

FIG. 1 illustrates a layout of a container for consumer goods in accordance with an exemplary embodiment of the present disclosure. As shown in FIG. 1, the container 100 includes a rigid outer box 102 having a hinged top 104 configured to provide access to a rigid inner box 106 and having a body 105 within which the inner box 106 is deposited. The inner box 106 has an opening 110 configured to provide access to consumer goods 112 stored or contained within an inner volume 109. The inner box 106 is of sufficient size to slidably and snugly fit within an inner volume 108 of the outer box 102. The inner box 106 can be securely held within the outer box 102 via contact friction between the surfaces of the inner box 106 and outer box 102. A pull tab 114 is arranged to cover the opening 110.

Figure 2A:
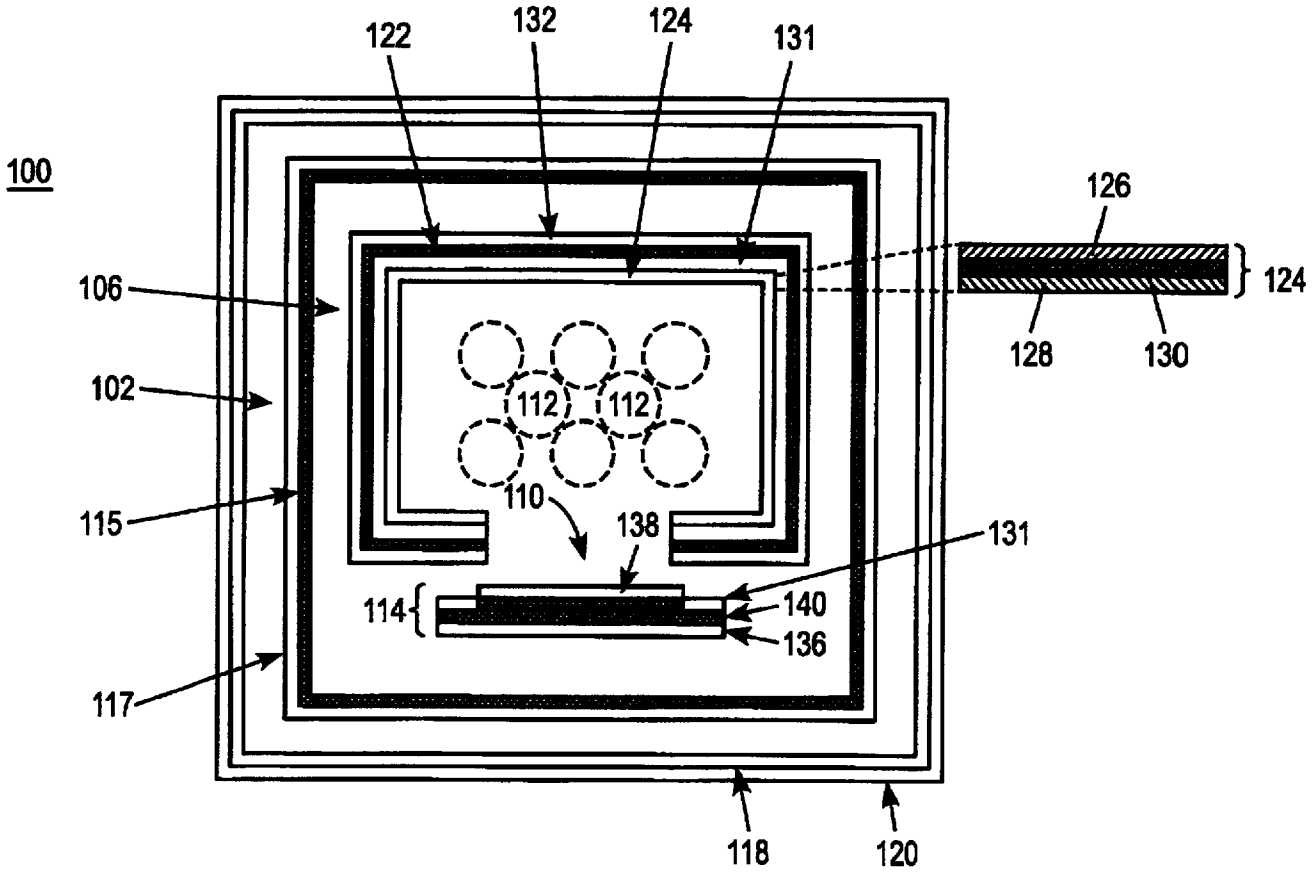

FIG. 2A illustrates a first perspective view of a layer structure of the container in accordance with an exemplary embodiment of the present disclosure. As shown in FIG. 2A, the outer box 102 includes one or more layers. A first layer 115 can be formed of a rigid material including cardboard, paperboard, or any other suitable material as desired. According to an exemplary embodiment, the first layer 115 can be formed of Promina SBS C1S Paperboard. According to another exemplary embodiment, the first layer 115 can be embossed with a design, lettering, pattern, and/or symbol as desired. A second layer 117 can include an ink, varnish, metallization, or other suitable material for product identification. When the container 100 is fully assembled, the outer box 102 can be wrapped with a third layer 118, such as a polypropylene film. The third layer 118 can include a tear tape 120 that allows for tearing open the polypropylene film 118.

The inner box 106 can include a plurality of layers. A first layer 122 can be formed of a rigid material such as cardboard, paperboard, or any other suitable material as desired. For example, according to an exemplary embodiment the first layer 122 can be formed of Promina SBS Board stock. A second layer 124 of the inner box 106 can include one or more layers formed as a bundle wrap. For example, the second layer 124 can include a foil layer 126 and a paper layer 128 as an inner liner bound by an adhesive 130. The paper layer 128 is the layer closest to or in contact with the consumer goods 112 stored in the inner box 106. According to an exemplary embodiment, the adhesive 130 used to bind the layers of the bundle wrap can include at least sodium silicate or any other suitable material as desired. The first layer 122 and the second layer 124 of the inner box 106 can also be bound to each other via an adhesive 131, such as a polyvinyl alcohol (PVA) based adhesive.

In accordance with another exemplary embodiment, the inner box 106 can also include a third layer 132 formed on a surface of the first layer 122. For example, the third layer 132 can include a polypropylene film or a metallized polyester (MET) material such that the layer structure of the inner box 106 includes bundle wrap/board/film or bundle wrap/board/MET, and more particularly the layer structure includes paper/foil/board/film or paper/foil/board/MET.

Figure 2B:
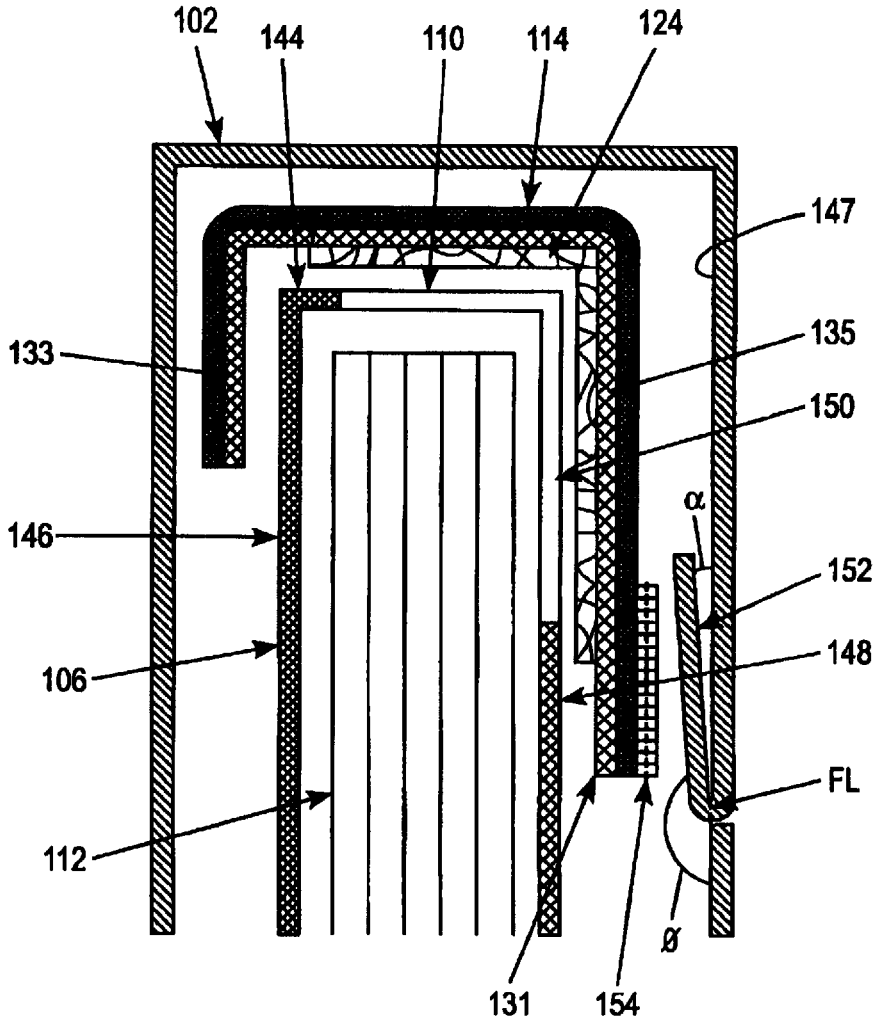

The pull tab 114 includes an adhesive layer 131 for adhering the pull tab 114 to the inner box 106 and a permanent adhesive layer 154, shown in FIG. 2B, that attaches the pull tab 114 to an inner surface 134 of the hinged lid 104 of the outer box 102. The pull tab 114 can also include a plurality of layers comprising a polymer material 136, a paper layer 138, and an adhesive layer 140 disposed between the polymer material 136 and the paper layer 138.

FIG. 2B illustrates a second perspective view of the layer structure of the container in accordance with an exemplary embodiment of the present disclosure. As shown in FIG. 2B, the adhesive layer 131 of the pull tab 114 includes a permanent adhesive area 133 and a non-permanent (e.g., re-sealable) adhesive area 135. The permanent adhesive area 133 can be arranged to extend from a top surface 144 of the inner box 106 to a rear surface 146 of the inner box 106. The non-permanent adhesive area 135 surrounds an adhesive-free region (not shown) of the adhesive layer 131, and is arranged to contact portions of the top surface 144 and a front surface 148 of the inner box 106 that border the opening 110.

The outer box 102 includes a front flap 152 that is adhered to the pull tab 114 via a permanent adhesive 154. The front flap 152 can be folded about a fold line FL so that it forms the inner surface 134 of the hinged lid 104 to which the pull tab 114 is attached. It should be understood that the material properties of the outer box 102 provide that once folded the front flap 152 can be spaced from the surface of the outer box at an angle $\alpha$, where $0<\alpha<90°$. The opposite side of front flap 152 is not adhered to the hinged lid 104, which allows the front flap 152 to freely move (e.g., rotate) about the fold line FL when a tension force between the front flap and the pull tab 114 is generated during opening and closing of the hinged lid 104. For example, the tension force applied to the front flap 152 during opening of the hinged lid 104 causes the front flap 152 to move about the fold line FL, which results in the pull tab 114 gradually peeling away from the top and front surfaces 144, 148 of the inner box 106 along a length of the non-permanent adhesive area 135 to fully uncover the opening 110. As the hinged lid 104 is closed, the tension force applied to the front flap 152 results in the pull tab 114 gradually rolling onto the top and front surfaces 144, 148 of the inner box 106 to re-establish the seal and fully cover the opening 110. According to an exemplary embodiment, the front flap can move (e.g., rotate) about the fold line FL within an angle $\phi$, where $0<\phi<180°$.

According to another exemplary embodiment, the front flap 152 can be adhered to a back surface 147 of the hinged lid 104. In this arrangement the pull tab 114 follows the contour of the hinged lid 104 such that when the hinged lid 104 is opened, a substantial portion (e.g., greater than half the length) of the pull tab 114 is instantly pulled away from the top and front surfaces 144, 148 of the inner box 106. In addition, when the hinged lid 104 is closed, a substantial portion (e.g., greater than half the length) of the pull tab 114 is instantly pressed onto the top and front surfaces 144, 148 of the inner box 106.

Figure 3A:
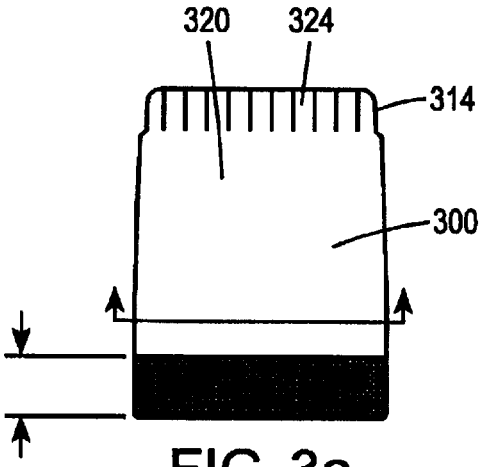
Figure 3B:
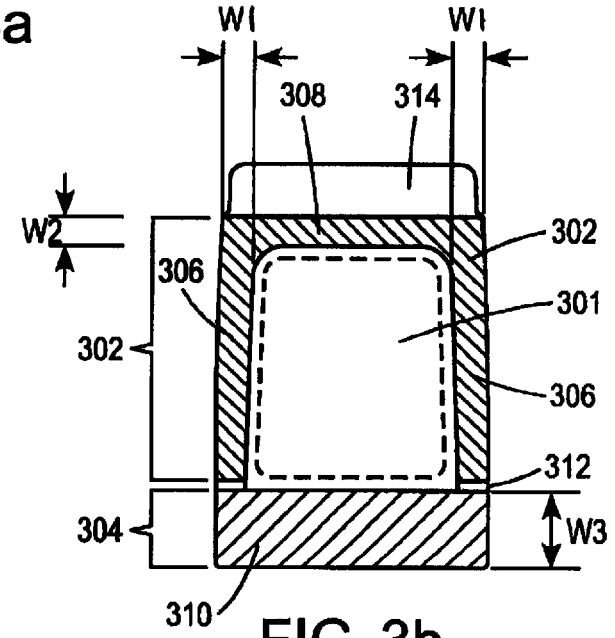
Figure 3C:
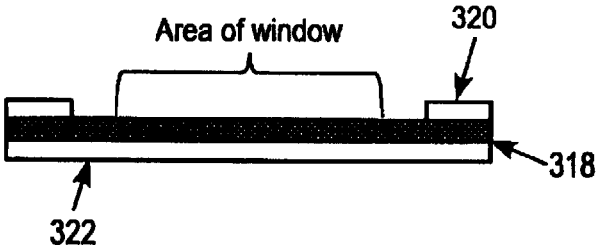

FIGS. 3A-C illustrate a first pull tab of the container in accordance with an exemplary embodiment of the present disclosure. As shown in FIGS. 3A-B, the pull tab 300 can include an adhesive-free area 301 which overlies opening 110 and can form a window if the pull tab is made of a transparent polymer material, a first adhesive area 302, and a second adhesive area 304. The first adhesive area 302 and the second adhesive area 304 can be formed on a lower surface or inner box-side surface of the pull tab 300. The pull tab can be formed in any desired shape or size sufficient to fully cover and seal the opening 110 of the inner box 106 when the outer box 102 is closed. The pull tab 300 can be formed from a single layer of polymer material such as PET or other suitable material such as a multi-layer laminate as desired. According to an exemplary embodiment, the pull tab 300 can be formed of a 2 mils thick piece of PET. The adhesive-free area 301 is arranged approximately in a central region of the pull tab 300 and aligned to fully cover the opening 110 when the pull tab 300 is adhered to the inner box 106. For example, left and right edge regions 306 located on opposites sides of the adhesive-free area 301 are of approximately the same width W1. A width W2 of a bottom edge region 308 located below the adhesive-free area 301 can be larger than a width W3 of a top edge region 310 above the adhesive-free area 301. The first adhesive area 302 includes a re-sealable adhesive film formed on the bottom edge region 308, the left and right edge regions 306, and the top edge region 310 of the pull tab 300, which surround the adhesive-free area 301. The re-sealable adhesive can include an ultra violet (UV) cured material, rubber based material, or a solvent based material. The second adhesive area 304 includes the top edge region 310 of the pull tab 300. The second adhesive portion 304 includes a permanent adhesive, which can be formed from UV-cured, rubber-based, or solvent-based materials.

The pull tab 300 includes a vent 312 that extends longitudinally from at least one of the left or right edge regions 306 of the adhesive-free area 301. The vent 312 is formed by an adhesive-free gap configured to allow the release of air located under the pull tab 300 when the pull tab 300 seals or re-seals the opening 110 as the hinged top 104 of the outer box 102 is closed. The pull tab 300 also includes a lip 314 on a bottom edge of the bottom edge region 308. The lip 314 can have permanent adhesive 324 on an outer surface to adhere to the front flap 152 of the hinged top 104 of the outer box 102.

As shown in FIG. 3C, the pull tab 300 can include a plurality of layers. A first layer 318 can be formed of polyethylene terephthalate (PET). A second layer 320 can be formed on the first layer 318 and includes adhesives applied to form the first and second adhesive portions 302, 304 already discussed. As discussed in FIG. 3A, the second layer 320 can be applied such that an adhesive-free region 301 is established. A third layer 322 can be formed on an opposite side of the first layer 318, and include an ink or other suitable print material as desired.

Figure 4A:
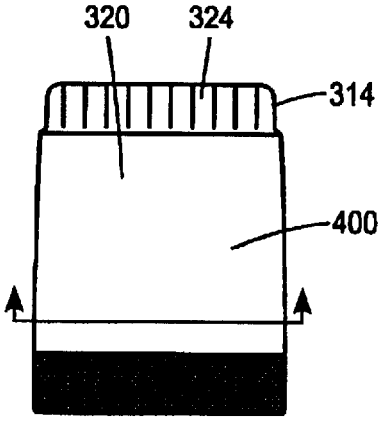
Figure 4B:
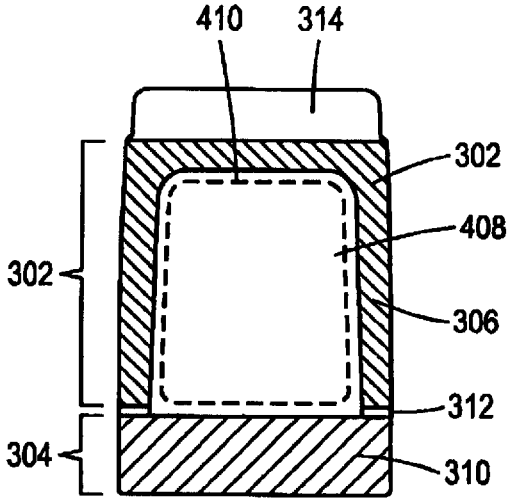
Figure 4C:
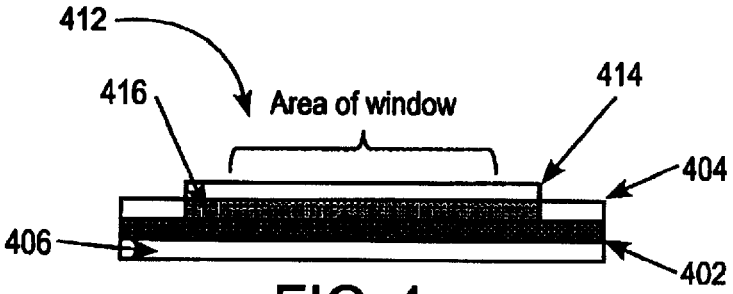

FIGS. 4A-C illustrate a second pull tab of the container in accordance with an exemplary embodiment of the present disclosure. An exemplary pull tab 400 can have substantially the same planar dimensions as the first pull tab 300 of FIG. 3A. The pull tab 400 can include a plurality of layers defined by the first, second, and third layers 402, 404, 406, which correspond to layers 318, 320, and 322, respectively, of FIGS. 3A-C. As shown in FIGS. 4A-C, the pull tab 400 can further include a fourth layer 408. The fourth layer 408 can be formed of a piece of bundle wrap 414 sized to fully cover and extend slightly past edges of opening 410 in the inner box 106. Instead of an adhesive-free area 301 as in FIG. 3C, the adhesive covers substantially the entire inner surface 412 or product side of the pull tab 400. The fourth layer 408 can be adhered to the pull tab 400 via a suitable adhesive 416 such as the re-sealable adhesive or the permanent adhesive; examples of which are discussed herein.

Figure 5:
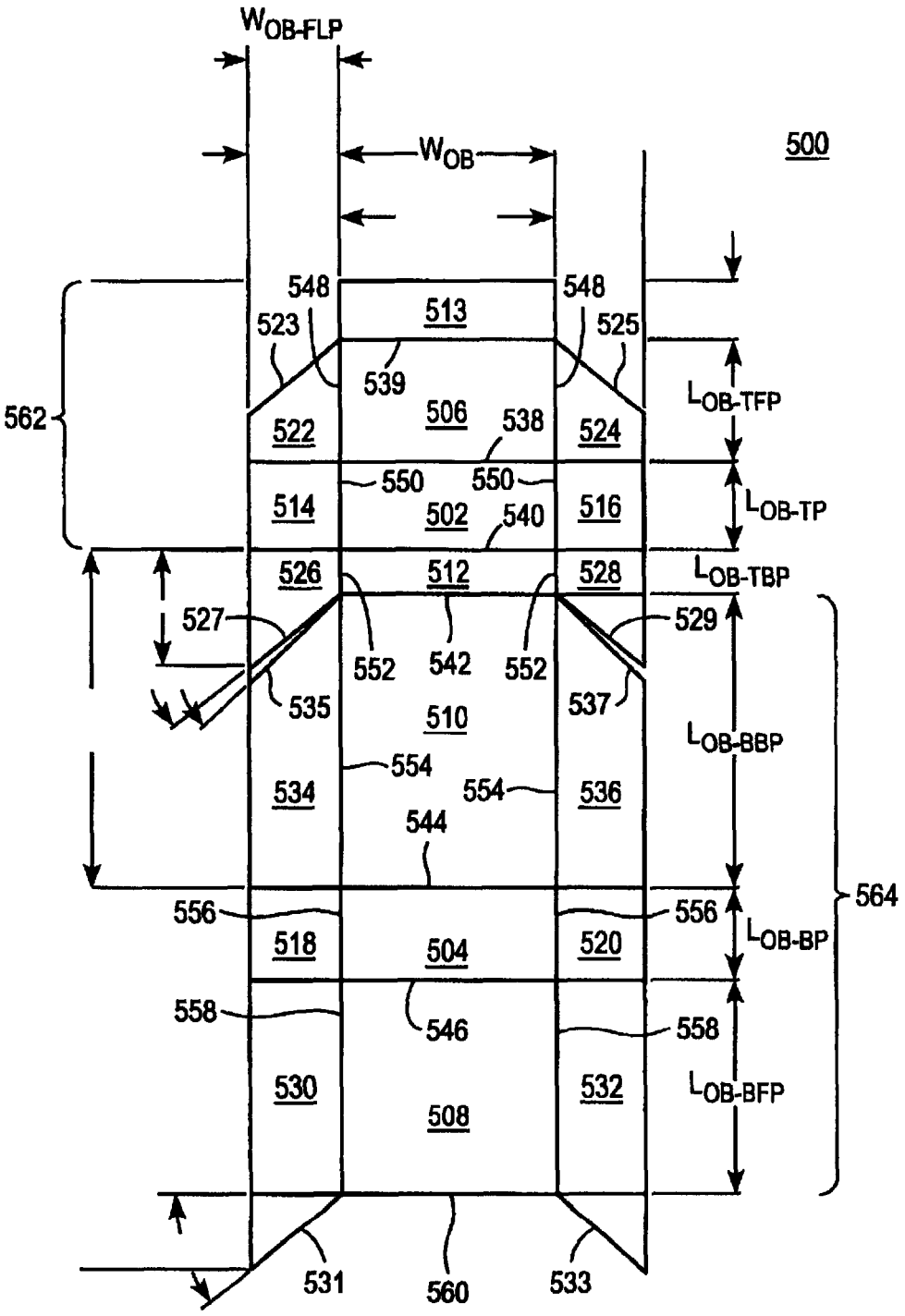
FIG. 5 illustrates a planar view of an outer box blank of the container in accordance with an exemplary embodiment of the present disclosure.

FIG. 5 illustrates a planar view of an outer box blank of the container in accordance with an exemplary embodiment of the present disclosure. As shown in FIG. 5, the blank 500 for forming outer box 102 includes a top panel 502, a bottom panel 504, a top front panel 506, a bottom front panel 508, a bottom back panel 510, and a top back panel 512. The top panel 502 includes a front flap 513. The top panel 502 and the bottom panel 504 include left and right dust flaps. The top panel 502 includes a left dust flap 514 and a right dust flap 516, and the bottom panel 504 includes a left dust flap 518 and a right dust flap 520. An upper section 562 of the outer box blank 500 includes the top panel 502, the top back panel 512, and the top front panel 508 and their associated side and dust flaps are configured to form the hinged top 104 of the assembled outer box 102 when folded. A lower section 564 of the outer box blank 500 includes the bottom panel 504, the bottom front panel 506, the bottom back panel 510 and their associated side and dust flaps discussed below are configured to form the body 105 of the assembled outer box 102 when folded.

The top back panel 512, the bottom front panel 508, and the bottom back panel 510 include left and right flaps. For example, the top front panel 506 includes a left side flap 522 and a right side flap 524; the top back panel 512 includes a left side flap 526 and a right side flap 528; the bottom front panel 508 includes a left side flap 530 and a right side flap 532; and the bottom back panel 510 includes a left side flap 534 and a right side flap 536.

Each panel of the outer box 102 and the associated left and right flaps are separated from an adjacent panel and its associated left and right flaps by a transverse fold line. The front flap 513 and the top front panel 506 are separated by transverse fold line 539. The top front panel 506, the left side flap 522, and the right side flap 524 are separated from the top panel 502, the left dust flap 514, and the right dust flap 516, respectively, by transverse fold line 538. The top panel 502, the left dust flap 514, and the right dust flap 516 are separated from the top back panel 512, the left side flap 526, and the right side flap 528, respectively, by transverse fold line 540. The top back panel 512, the left side flap 526, and the right side flap 528 are separated from the bottom back panel 510, the left side flap 534, and the right side flap 536, respectively, by transverse fold line 542. The bottom back panel 510, the left side flap 534, and the right side flap 536 are separated from the bottom panel 504, the left dust flap 518 and the right dust flap 520, respectively, by transverse fold line 544. The bottom panel 504, the left dust flap 518, and the right dust flap 520 are separated from the bottom front panel 508, the left side flap 530, and the right side flap 532, respectively, by transverse fold line 546.

Each side flap and dust flap of the outer box 102 is separated from the associated and adjacent panel by a longitudinal fold line. The top front panel 506 is separated from the left and right side flaps 522, 524 by longitudinal fold lines 548. The right side flap 524 has a pre-cut edge 525 that extends at an angle of approximately −45° from the transverse fold line 539. The left side flap 522 has a pre-cut edge 523 that extends at an angle of approximately −135° from the transverse fold line 539. The top panel 502 is separated from the left and right dust flaps 514, 516 by longitudinal fold lines 550. The top back panel 512 is separated from the left and right side flaps 526, 528 by longitudinal fold lines 552. The left side flap 526 has a pre-cut edge 527 that extends at an angle of approximately −50° from the transverse fold line 542. The right side flap 528 of top back panel 512 has a pre-cut edge 529 that extends at an angle approximately −140° from the transverse fold line 542. The bottom back panel 510 is separated from the left and right side flaps 534, 536 by longitudinal fold lines 554. The left side flap 534 has a pre-cut edge 535 that extends at an angle of approximately −45° from the transverse fold line 542. The right side flap 536 of the bottom back panel 510 has a pre-cut edge 537 that extends at an angle of approximately −135° from the transverse fold line 542. The bottom panel 504 is separated from the left and right dust flaps 518, 520 by longitudinal fold lines 556. The bottom front panel 508 is separated from the left and right side flaps 530, 532 by longitudinal fold lines 558. The left side flap 530 and the right side flap 532 extend past an edge 560 of the bottom front panel 508. The left side flap 530 has a pre-cut edge 531 that extends at approximately −45°, and in a preferred embodiment −39°, from the bottom edge 560 of the bottom front panel 508. The right side flap 532 a pre-cut an edge 533 that extends at approximately −135°, and in a preferred embodiment −129°, from the edge 560 of the front panel 508.

The pre-cut angle of the flaps associated with the bottom front panel 508 and bottom back panel 510 are complementary to the pre-cut angle of the flaps associated with the top front panel 506 and the top back panel 512 so that a side surface of the hinged top of the outer box mates with a side surface of a body of the outer box when the outer box is in a closed state.

The outer box 102 has dimensions suitable for providing a snug fit for the inner box 106 when disposed within the outer box 102. The outer box 102 has a width $W_{OB}$ that is common to each of the top panel 502, bottom panel 504, top front panel 506, bottom front panel 508, bottom back panel 510, and top back panel 512. The bottom back panel 510 has a length $L_{OB\text{-}BBP}$ that is substantially longer than the length of the top back panel ($L_{OB\text{-}TBP}$) 512. The sum of $L_{OB\text{-}BBP}$ and $L_{OB\text{-}TBP}$ is approximately equal to the length of a cigarette pack, e.g., the length of the inner box 106. The length of the bottom front panel ($L_{OB\text{-}BFP}$) 508 is substantially longer than the length of the top front panel ($L_{OB\text{-}TFP}$) 506. The sum of $L_{OB\text{-}BFP}$ and $L_{OB\text{-}TFP}$ is substantially equal to the sum of $L_{OB\text{-}BBP}$ and $L_{OB\text{-}TBP}$. According to an exemplary embodiment $L_{OB\text{-}BBP}$=75.10 mm, $L_{OB\text{-}TBP}$=11.40 mm, $L_{OB\text{-}BFP}$=55.5 mm, and $L_{OB\text{-}TFP}$=31.0 mm. The depth or thickness of the outer box 102 is equal to the width ($W_{OB\text{-}FLP}$) of the side and dust flaps and the length (e.g., shortest edge) of the top panel ($L_{OB\text{-}TP}$) 502 and bottom panel ($L_{OB\text{-}BP}$) 504. According to an exemplary embodiment $L_{OB\text{-}TP}$=$L_{OB\text{-}BP}$=$W_{OB\text{-}FLP}$=21.9 mm.

Figure 6:
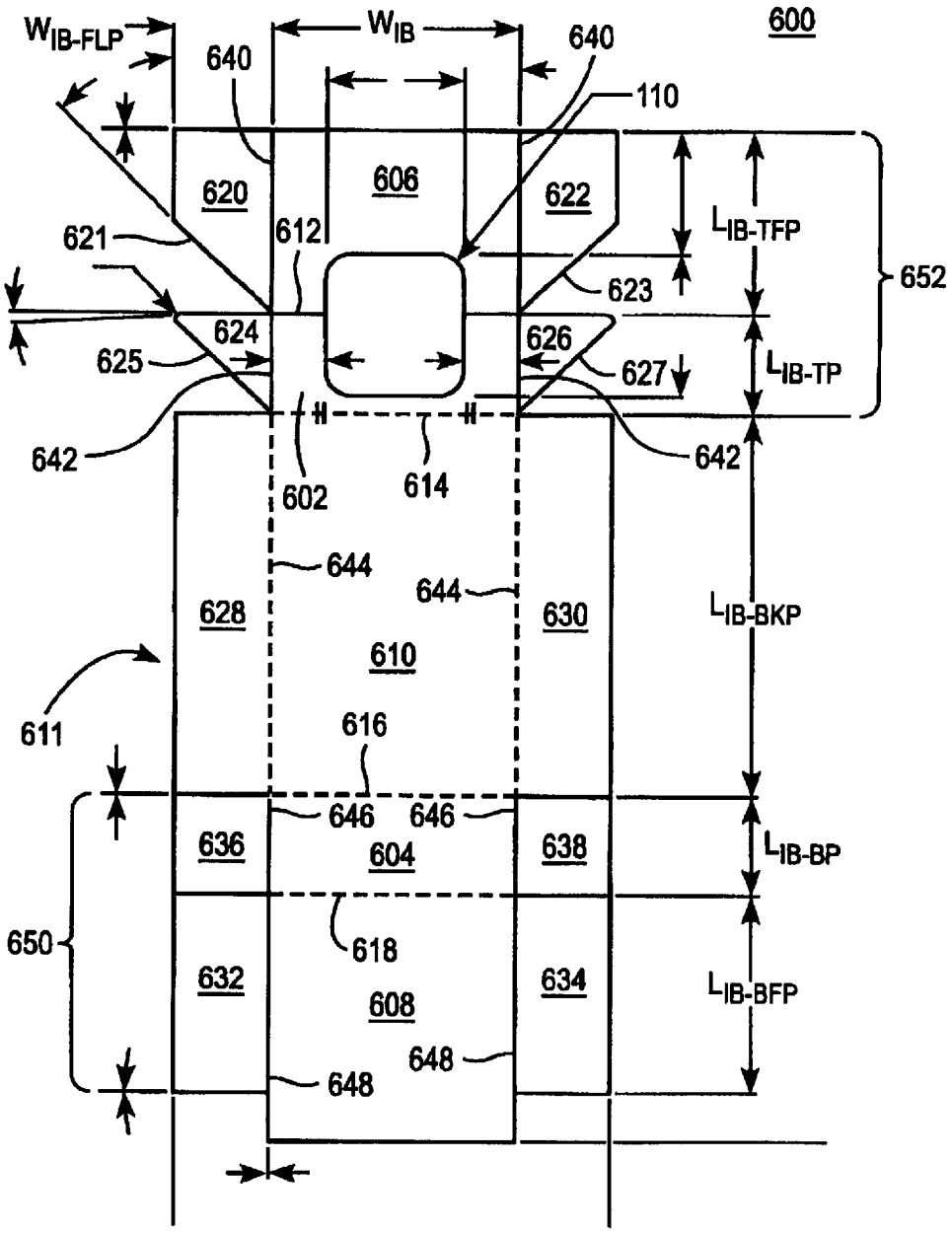
FIG. 6 illustrates a planar view of an inner box blank of the container in accordance with an exemplary embodiment of the present disclosure.

FIG. 6 illustrates a planar view of a blank for forming an inner box 106 of the container in accordance with an exemplary embodiment of the present disclosure. As shown in FIG. 6, the blank 600 for inner box 106 includes a top panel 602, a bottom panel 604, a top front panel 606, a bottom front panel 608, and a back panel 610. The opening 110 of the inner box extends across the top front panel 606 and the top panel 602. A surface 611 of the inner box blank can be substantially covered with a bundle layer. The surface 611 establishes the product side surface of the assembled inner box 106.

Each panel is separated from an adjacent panel by a transverse fold line. The top front panel 606 is separated from the top panel 602 by a transverse fold line 612. The top panel 602 is separated from the back panel 610 by a transverse fold line 614. The back panel 610 is separated from the bottom panel 604 by a transverse fold line 616. The bottom panel 604 and the bottom front panel 608 are separated by transverse fold line 618.

Each panel includes associated side flaps. The top front panel 606 includes a left side flap 620 and a right side flap 622. The left side flap 620 has a pre-cut edge 621 that extends at an angle of approximately 45° from the transverse fold line 612. The right side flap 622 has a pre-cut edge 623 that extends at an angle of approximately 135° from the transverse fold line 612. The top panel 602 includes a left side flap 624 and a right side flap 626. The left side flap 624 has a pre-cut edge 625 that extends at an angle of approximately 45° from the transverse fold line 614. The right side flap 626 has a pre-cut edge 627 that extends at an angle of approximately 135° from the transverse fold line 614. The bottom back panel 610 includes left side flap 628 and a right side flap 630. The front panel 608 includes a left side flap 632 and a right side flap 634. The bottom panel 604 includes a left dust flap 636 and a right dust flap 638.

The inner box 106 has dimensions suitable for storing a desired number (e.g., count) of consumer goods, which according to an exemplary embodiment are cigarette articles. The inner box 106 has a width $W_{IB}$ that equals the width of each of the top panel 602, bottom panel 604, top front panel 606, bottom front panel 608 and back panel 610. The back panel 610 has a height or length ($L_{IB-BKP}$) sufficient for enclosing the consumer goods. The sum of the lengths of the top front panel 606 ($L_{IB-TFP}$) and the bottom front panel ($L_{IB-BFP}$) 608 is equivalent to $L_{IB-BKP}$. According to an exemplary embodiment of the present disclosure, $L_{IB-BKP}$=83.6 mm, $L_{IB-TFP}$=27.2 mm, and $L_{IB-BFP}$=43.39 mm. The depth or thickness of the inner box 106 is established by the width $W_{IB-FLP}$ shared by each of the side and dust flaps and the length (e.g., shortest edge) of the top panel ($L_{IB-TP}$) 602 and bottom panel ($L_{IB-BP}$) 604. According to an exemplary embodiment, $L_{IB-TP}=L_{IB-BP}=W_{IB-FLP}$=20.55 mm.

According to exemplary embodiments of the present disclosure, a sum of lengths of the top back panel 512 and bottom back panel 510 of the outer box 102 is at least equal to a length of the back panel 610 of the inner box 106, where ($L_{OB-TBP}+L_{OB-BBP}=L_{IB-BKP}$), and in a preferred embodiment the sum of lengths is greater, where ($L_{OB-TBP}+L_{OB-BBP}>L_{IB-BKP}$), so that the proper fit of the inner box 106 within the outer box 102 and closure of the hinged top 104 can be realized.

Each side and dust flap of the inner box 104 is separated from the associated and/or adjacent panel by a longitudinal fold line. The top front panel 606 is separated from the left and right side flaps 620, 622 by longitudinal fold lines 640. The top panel 602 is separated from left and right side flaps 624, 626 by longitudinal fold lines 642. The back panel 610 is separated from left and right side flaps 628, 630 by longitudinal fold lines 644. The bottom panel 604 is separated from left and right dust flaps 636, 638 by longitudinal fold lines 646. The bottom front panel 608 is separated from left and right side flaps 632, 634 by longitudinal fold lines 648.

FIGS. 7A-B are flow charts of a process for making the container in accordance with an exemplary embodiment of the present disclosure; and FIG. 8 illustrates a sequence of assembly states of the container according to the assembly process of FIGS. 7A-B.

As shown in FIGS. 7A-B, the process includes a first step (S700) in which the inner box 102 is assembled from the inner box blank 600 by folding the left and right side flaps 628, 630 about the longitudinal fold lines 644 so that they are substantially orthogonal to the back panel 610. In step S702, the dust flaps 636, 638 of the bottom panel 604 are folded over the longitudinal fold lines 646 so that they are substantially planar with the bottom panel 604. According to an exemplary embodiment, an adhesive can be applied to the dust flaps 636, 638 so that they adhere to the bottom panel 604 when folded. As shown in State 1 of FIG. 8, a lower section 650 including the bottom panel 604 and the bottom front panel 608 is folded about transverse fold line 616 so that it is substantially orthogonal to the bottom panel 604 (S704). The consumer goods or product is then placed into the area bounded by the left and right side flaps 628, 630 and the bottom panel 604 (S706). An upper section 652 including the top panel 602 and the top front panel 606 is folded about transverse fold line 614 so that the upper section 652 is substantially orthogonal to the back panel 610 (S708, State 2). The bottom front panel 608 is folded over transverse fold line 618 so that it is parallel with the back panel 610 (S710, State 3). The top front panel 606 is folded over transverse fold line 612 so that it is parallel with the back panel 610 and planar with the bottom front panel 608 (S712, State 4). As shown in FIG. 6, the bottom front panel 608 includes a free end which extends beyond the side flaps 632, 634 and when the top front panel 606 is folded over the fold line 612, the free end of the top front panel 606 covers the free end of the bottom front panel 608.

An adhesive can be applied to the left and right side flaps 624, 626 of the top panel 602. The left and right side flaps 624, 626 of the top panel 602 are folded over longitudinal fold lines 642 and adhere to the side flaps 628, 630 of the back panel 610 (S714, State 5). An adhesive can be applied to the side flaps 632, 634 of the bottom front panel 608 and to the left and right side flaps 620, 622 of the top front panel 606. The side flaps 632, 634 of the bottom front panel 608 are folded about longitudinal fold lines 648 and adhere to the left and right side flaps 628, 630, respectively, of the back panel 610 (S716, State 6). The left and right side flaps 620, 622 of the top front panel 606 are folded about longitudinal fold lines 640 and adhere to the left and right side flaps 628, 630, respectively, of the back panel 610 (S718, State 6). In an embodiment, the left and right side flaps 620, 622 of the top front panel 606 are planar with and do not overlap the side flaps 624, 626, respectively of the top panel 602 because of the pre-cut angles of their respective edges. In another embodiment, the side flaps 620, 622 overlap the side flaps 624, 626 and there is no adhesive between the overlapping top front and bottom front panels 606, 608. The pull tab 114 is placed on the inner box 104 to cover the opening 110 (S720, State 7). In particular, the second adhesive portion 310 of the pull tab 114 adheres to the back panel 610 of the inner box 106. The pull tab 114 is then folded over the top of the inner box 106 so that the first adhesive portion 302 adheres to the left, right, and upper portions of the top panel 602 and top front panel 606 that surround the opening 110 (State 7).

The outer box 102 is assembled from the outer box blank 500 by folding the left and right side flaps 534, 536 of the bottom back panel 510 about longitudinal fold lines 554 so that the left and right side flaps 534, 536 are substantially orthogonal to the bottom pack panel 510 (S720). The left and right dust flaps 518, 520 of bottom panel 504 are folded over longitudinal fold lines 556 so that they are substantially planar with each other and parallel with the bottom panel 504 (S722, State 8). According to an exemplary embodiment, adhesive can be applied to the left and right dust flaps 518, 520 so that they adhere to the bottom back panel 510 when folded. A lower section 505 of the outer box 102 including the bottom panel 504 and the bottom front panel 508 is folded about transverse fold line 544 so that the lower section 505 is substantially orthogonal to the bottom back panel 510 (S724, State 8). The assembled inner box 106 is placed within the area of the outer box 102 bounded by the left and right side flaps 534, 536 and the bottom panel 504 (S726, State 9). The bottom front panel 508 is folded over transverse fold line 546 so that the panel is substantially parallel with the bottom back panel 510 (S728, State 10). An adhesive can be applied to the left and right side flaps 530, 532 of the bottom front panel 508. The side flaps 530, 532 are then folded about longitudinal fold lines 558 and adhere to the left and right side flaps 534, 536, respectively, of the bottom back panel 510 (S730).

An upper section 503 of the outer box 102 including the top panel 502 and the top front panel 506 is folded about transverse fold line 540 so that the upper section 503 is substantially orthogonal to the bottom back panel 510 (S732, State 10). The left and right side flaps 526, 528 of the top back panel 512 are folded about longitudinal fold lines 552 so that they are planar with the left and right side flaps 534, 536, respectively, of the bottom back panel 510 (S734). It is noted that the angled edges of the left and right side flaps 534, 536 of the bottom back panel 510 and the angled edges of the left and right side flaps 526, 528, respectively, of the top back panel 512 are pre-cut so that they do not overlap and allow for opening of the hinged top 104 of the outer box 102. The top front panel 506 is folded about transverse fold line 538 so that the top front panel 506 is parallel with the bottom back panel 510 and planar with the bottom front panel 508 (S736, State 11). An adhesive is applied to the left and right side flaps 522, 524 of the top front panel 506. The left and right side flaps 522, 524 of the top front panel 506 are then folded about longitudinal fold lines 548 and adhere to the folded left and right side flaps 526, 528, respectively of the top back panel 512 (S738, State 11). Attaching the bottom edge region 308 of the pull tab 114 having the permanent adhesive to the front flap 513 and folding the front flap 513 about transverse fold line 539 so that the front flap 513 establishes the inner surface 134 of the hinged lid 104 to which the pull tab 114 is attached (S740, State 11). According to another exemplary embodiment, the front flap 513 can be adhered to a back surface 147 of the top front panel 506 after being folded about the transverse fold line 539.

FIGS. 9A-B illustrate an assembled container in accordance with an exemplary embodiment of the present disclosure. As shown, the assembled container 900 includes the rigid outer box 902 and the rigid inner box 904. The outer box 902 includes the hinged lid 906 for accessing the inner box 904 and the inner box 904 includes an opening 908 for accessing the consumer goods (not shown). The container 900 also includes a pull tab 910 that is affixed to the outer box 902 and inner box 904 via areas having areas of permanent and re-sealable adhesives. The pull tab 910 is affixed to an inner surface 912 of the hinged lid 906 established by the folded front flap 513 of the outer box blank 500 via the permanent adhesive. When the hinged lid 906 is closed, the pull tab 910 fully covers the opening 908 of the inner box 904 by adhering to a surface of the inner box 904 surrounding the opening 908 via the re-sealable adhesive. Alternatively, when the hinged lid 906 is opened, the pull tab 910 fully uncovers the opening 908 and remains adhered to the hinged lid 906 of the outer box 902 and to the inner box 904 via the areas having the permanent adhesive.

FIGS. 10A-E show details of a pull tab in accordance with an embodiment wherein FIG. 10A shows a succession of pull tabs on a backing strip, FIG. 10B shows an outer side of the pull tab with dots of permanent adhesive, FIG. 10C shows an underside of the pull tab with zones of permanent adhesive and re-stick adhesive, FIG. 10D shows an underside of the pull tab with a piece of foil/paper at a location which overlies an extraction opening in the inner box, and FIG. 10E shows a piece of the foil/paper which is adhered to the underside of the pull tab.

As shown in FIG. 10A, a succession of pull tabs 10 are arranged along a backing strip 12 which can be rolled onto a bobbin for use in a packaging machine which assembles the inner boxes. Each pull tab 10 can be peeled from the backing strip 12 and placed over an assembled inner box such that the pull tab is permanently attached to the upper backside of the inner box and the remainder of the pull tab can cover the extraction opening (illustrated by dotted lines 18) in the top and upper front portions of the inner box.

As shown in FIG. 10B, an outer surface 14 of the pull tab 10 includes dots of permanent adhesive 16 along a portion of the pull tab below a line of weakness 20 formed by a transverse row of perforations, score line, or other mechanical equivalent. The pull tab 10 can optionally include an area 22 of contrasting color and/or gloss or a 100% black eyemark across the upper portion of the pull tab and optional smaller areas 24, 26 of contrasting color and/or gloss or a 100% black eyemark at bottom corners of the pull tab. The pull tabs can have a rectangular shape with parallel upper and lower edges and parallel side edges with square or rounded corners. In the embodiment shown in FIG. 10B, the pull tab 10 has a width slightly smaller than the width of an inner box (illustrated by rectangular box 11). The pull tab 10 has a length such that when the pull tab 10 is attached to an inner box, the pull tab 10 covers the top of the inner box 11 and covers the upper portions of the front and back sides of the inner box 11.

As shown in FIG. 10C, an inner surface 28 of the pull tab 10 includes a rectangular area 30 of permanent adhesive extending across the top of the pull tab and an area 32 of re-stick adhesive extending across the bottom of the pull tab. Depending on machine tolerances, the permanent adhesive 30 and the re-stick adhesive 32 are preferably applied to the pull tab with an adhesive-free gap 34 between them. The gap 34 provides an air vent which allows air to escape from inside the inner box when the pull tab 10 closes the extraction opening in the inner box. For example, the gap 34 can be about 1 mm wide and located about 3 mm from the location of the extraction opening (illustrated by dotted lines 18). The line of perforations 20 can be located about 2 mm below the location of the extraction opening and about 8 mm above a lower edge of the pull tab. As an example of the pull tab and extraction opening dimensions, the extraction opening can be about 30 mm wide and about 32.5 mm long and the pull tab 10 can be about 50 mm wide and about 65 mm long.

As shown in FIG. 10C, the re-stick adhesive 32 covers the pull tab except along the lower side edges 34, 36 and bottom edge 38 of the pull tab 10. For example, the re-stick adhesive can be applied in a pattern which has a weaker adhesion force at the bottom edge 38 of the pull tab 10 and a stronger adhesion force above the line of perforations 20. The line of perforations 20 forms a connecting tab 40 which is permanently attached to the inside of the hinged lid of the outer box. Thus, when the hinged lid is opened, the re-stick adhesive 32 on the underside of the connecting tab 40 provides a weaker adhesion force holding the pull tab 10 to the outer surface of the inner box than the remainder of the re-stick adhesive above the line of perforations 20.

In an embodiment, the lower portion of the re-stick adhesive can be applied with a saw tooth pattern 42 extending across the connecting tab 40. In the saw tooth pattern shown in FIG. 10C, four triangular regions of re-stick adhesive cover about 40 to 60% of the connecting tab 40. Preferably, the area of re-stick adhesive is smallest (e.g., minimum) at the bottom edge 38 of the pull tab, larger (e.g., midpoint) at the line of perforations 20 and largest (e.g., maximum) at a location above the line of perforations 20. For example, the re-stick adhesive 32 can begin to decrease in area at about 16 mm above the bottom edge 38, decrease in area by about 50% or less at the location of the line of perforations 20, and reach a minimum at about 1 mm from the bottom edge 38 of the pull tab 10.

FIG. 10D shows the pull tab 10 with a piece of foil/paper 44 adhered to the re-stick adhesive 32 so as to cover the location of the extraction opening (illustrated with dotted lines 18). For example, the foil/paper piece 44 can be a piece of bundle wrap typically used to wrap a bundle of cigarettes and the piece 44 is adhered to the pull tab 10 with the paper side of the piece 44 exposed. When the pull tab 10 is applied to an inner box containing cigarettes, the paper side of the piece 44 will be in contact with ends of the cigarettes. As an example of part dimensions, the piece 44 can be sized to extend about 2 mm beyond the extraction opening (illustrated by dotted lines 18). FIG. 10E shows the piece 44 prior to being attached to the pull tab 10. In the case of an extraction opening about 30 mm wide and about 32.5 mm long, the piece 44 can be about 34 mm wide and about 36.5 mm long. The extraction opening can have rounded corners (as illustrated by the dotted lines 18 in FIG. 10D) and the piece 44 can also have rounded corners as shown in FIG. 10E.

The container can have various design features. For example, the consumer goods can comprise a bundle of loose smoking articles and the pull tab can comprise a flexible sheet of polymer material having re-stick adhesive on the underside thereof wherein the paper liner comprises a substantially square piece of bundle wrap adhered to the pull tab by the re-stick adhesive such that a paper side of the bundle wrap is exposed and faces the smoking articles in the inner box.

The pull tab can be rectangular in shape and cover at least 90% of a width of the front, top and back walls, the pull tab including a rectilinear line of weakening extending across the pull tab at a predetermined distance from a bottom edge of the pull tab such that a portion of the pull tab below the line of weakening forming a rectangular connecting tab adhered to the inner surface of the hinged lid with the permanent adhesive. The opening can include a cut-out in the top wall which extends at least 50% of a distance between the side walls and at least 70% of a distance between the front and back walls and a cut-out in the front wall which extends at least 50% of the distance between the side walls and less than 20% of a distance between the top and bottom walls.

In a preferred embodiment, the pull tab can be attached to the hinged lid by permanent adhesive attaching an outer surface of the pull tab to the inner surface of the hinged lid and the pull tab is attached to the inner box by permanent adhesive attaching an inner surface of the pull tab to an upper portion of the back wall of the inner box. The pull tab can comprise a film of polyethylene terephthalate (PET) and the paper liner can comprise a piece of paper laminated to metal foil.

In an embodiment, the container includes an outer box having the size of a traditional cigarette pack. For instance, the outer box can have a height of about 3 to 4 inches, a width of about 2 to 2.5 inches, and a thickness of about 1 to 1.25 inches with the inner box sized to fit snugly within the outer box. For example, the outer box can be about 88 mm high, about 56 mm wide and about 23 mm thick, with the inner box being about 86 mm high, 55 mm wide, and 22 mm thick. The size of the container will depend on the size of the consumer goods. Where the consumer goods are cigarettes, the size of the container can be designed to accommodate 20 cigarettes having lengths of 40 to 180 mm and diameters of 4 to 9 mm. Thus, the outer dimensions of the container will be slightly larger than the dimensions of the cigarette bundle, e.g., the height, width and thickness of the container can be at least 1 mm larger in each direction than the dimensions of an unwrapped cigarette bundle.

The pull tab can be a rectangular shaped sheet with a width of about 50 mm and a length of about 65 mm. The paper liner can be a rectangular shaped sheet with a width of about 34 mm and a length of about 36 mm. The pull tab can include a rectilinear line of weakening located about 8 mm from one end of the pull tab to form a connecting tab at the bottom of the pull tab.

The pull tab can include one or more machine readable markings on an inner surface and/or outer surface. For example, the pull tab can include a large black mark extending completely across the upper end of the underside of the pull tab and smaller black marks at opposite lower corners on the upper side of the pull tab.

The paper liner can have an outer periphery which extends about 2 mm beyond an outer periphery of the opening. The pull tab can be permanently adhered to the back wall and a portion of the top wall of the inner box. The opening can have a width of about 30 mm and a depth of about 16 mm in the top wall of the inner box and a width of about 30 mm and a depth of about 16 mm in the front wall of the inner box. The pull tab can also include a connecting tab defined by a rectilinear line of 2.5 mm long perforations located about 8 mm from a lower edge of the pull tab.

In other arrangements, the inner box can comprise a plurality of layers wherein an innermost surface of the inner box is a light paper layer (e.g., 19 pound paper), an intermediate layer is a metal foil layer, and an outer layer is a heavy paper layer (e.g., paperboard). For example, the light paper layer and the metal foil layer can comprise a sheet of bundle wrap and the sheet of bundle wrap can be adhered to the heavy paper layer and the bundle wrap can be adhered to the heavy paper layer. The pull tab can include re-stick adhesive in a single zone and permanent adhesive in first and second zones, the first zone located at an upper portion of an inner surface of the pull tab and the second zone located at a lower portion of an outer surface of the pull tab. In a preferred embodiment, the consumer goods are a bundle of unwrapped cigarettes in direct contact with an inner surface of the inner box.

The pull tab is preferably rectangular in shape with parallel upper and lower edges and parallel side edges, the side edges having a length greater than a width of the upper and lower edges, the first zone of permanent adhesive having a rectangular shape extending about 30% of the length of the pull tab, the single zone of re-stick adhesive having a substantially rectangular shape extending about 70% of the length of the pull tab.

In an embodiment, the first zone of permanent adhesive can be separated from the single zone of re-stick adhesive by an adhesive-free uniform gap about 1 to about 2 mm wide, the single zone of re-stick adhesive includes an upper border parallel to the upper edge of the pull tab, side borders parallel to the side edges of the pull tab, and a lower border which provides a decreasing area of re-stick adhesive in a direction towards the lower edge of the pull tab, and an adhesive-free border extends completely around the inner surface of the pull tab, the adhesive-free border extending no more than about 2 mm from the outer periphery of the pull tab and/or the pull tab includes at least one machine readable marking on an outer surface thereof.

The single zone of re-stick adhesive can include an upper border parallel to the upper edge of the pull tab, side borders parallel to the side edges of the pull tab, and a lower border which provides a decreasing area of re-stick adhesive in a direction towards the lower edge of the pull tab. In a preferred embodiment, an adhesive-free border extends completely around the inner surface of the pull tab, the adhesive-free border extending no more than about 2 mm from the outer periphery of the pull tab. The first zone of permanent adhesive and the single zone of re-stick adhesive can be separated by an adhesive-free gap extending completely across the pull tab to the adhesive-free border on opposite sides of the pull tab.

The consumer goods are preferably a bundle of loose smoking articles which are not wrapped in bundle wrap by instead are placed directly in the inner box. The paper liner can comprise a pre-cut piece of bundle wrap with one side thereof adhered to the pull tab and a paper layer of the bundle wrap facing the smoking articles in the inner box. In an embodiment, the pull tab includes a rectilinear line of weakening extending across the pull tab at a predetermined distance from a bottom edge of the pull tab such that a portion of the pull tab below the line of weakening forms a hinged connecting tab attached to the hinged lid.

The connecting tab can include an adhesive-free area and a re-stick adhesive area on an inner surface thereof, the adhesive-free area decreasing in size in a direction away from a lower edge of the connecting tab and the re-stick adhesive area decreasing in size in a direction towards the lower edge. The permanent adhesive can be located in first and second zones, the first zone located at an upper portion of the inner surface of the pull tab and the second zone located at a lower portion of an outer surface of the pull tab, the second zone of permanent adhesive attaching the connecting tab to an inside surface of the hinged lid, the re-stick adhesive area forming part of a single zone of re-stick adhesive extending from the connecting tab to the first zone of permanent adhesive.

In various design variations, (a) the pull tab can comprise a piece of polymer film having a substantially rectangular shape with parallel upper and lower edges and parallel side edges, the side edges having a length greater than a width of the upper and lower edges, (b) the first zone of permanent adhesive can have a rectangular shape extending about 30% of the length of the pull tab and the single zone of re-stick adhesive can have a substantially rectangular shape extending about 70% of the length of the pull tab, (c) the first zone of permanent adhesive can be separated from the single zone of re-stick adhesive by a uniform gap about 1 to about 2 mm wide, (d) the single zone of re-stick adhesive can include an upper border parallel to the upper edge of the pull tab, side borders parallel to the side edges of the pull tab, and a lower border which provides a decreasing area of re-stick adhesive in a direction towards the lower edge of the pull tab, (e) an adhesive-free border can extend completely around the inner surface of the pull tab with the adhesive-free border extending no more than about 2 mm from the outer periphery of the pull tab, (f) the adhesive-free gap can extend completely across the pull tab to the adhesive-free border on opposite sides of the pull tab, and/or (g) the pull tab can include at least one machine readable marking on an inner and/or outer surface thereof.

In an embodiment, the pull tab can include a line of weakening such a line of perforations extending transversely across the pull tab at a location corresponding to the upper back edge of the inner box, i.e., the edge between the back panel and the top panel. The first zone of permanent adhesive can extend over the line of weakness such that when the pull tab is attached to an inner box, the line of weakness is aligned with the top back edge of the inner box and the first zone of permanent adhesive contacts the an upper portion of the back panel and a portion of the top panel adjacent the back panel. As an example, the line of weakening can be arranged such that about 80% of the first zone of permanent adhesive is located on the back panel of the inner box and about 20% of the first zone of adhesive is located on the top panel of the inner box.

In another embodiment, the pull tab can include re-seal adhesive covering the connecting tab with one or more areas of the re-seal adhesive deadened to promote peeling of the pull tab when the outer box is opened. FIGS. 11A-H show variations of where the re-seal adhesive 32 can be deadened.

Figure 11A:
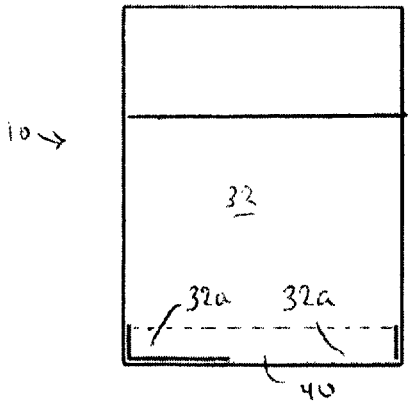

FIG. 11A shows Option A wherein the re-seal adhesive 32 is deadened in two spaced apart triangular regions 32*a* at the lower corners of the connecting tab 40, each of the triangular regions 32*a* having a length at one end about equal to the length of the connecting tab 40 and decreasing in area in a direction towards a center of the connecting tab 40.

Figure 11B:
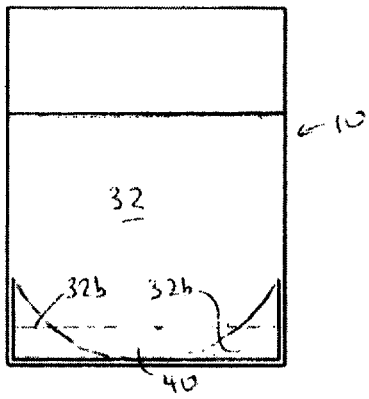

FIG. 11B shows Option B wherein the re-seal adhesive 32 is deadened in two spaced apart arcuate regions 32*b* located at the lower corners of the connecting tab 40, each of the arcuate regions 32*b* having a length greater than a length of the connecting tab 40 and decreasing in area in a direction towards a center of the connecting tab 40.

Figure 11C:
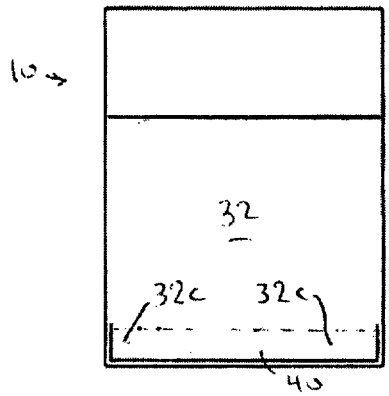

FIG. 11C shows Option C wherein the re-seal adhesive 32 is deadened in two triangular regions located 32*c* at lower corners of the connecting tab 40, each of the triangular regions 32*c* having a length about equal to a length of the connecting tab 40 and decreasing in area from an outer edge of the connecting tab to the center of the connecting tab 40.

Figure 11D:
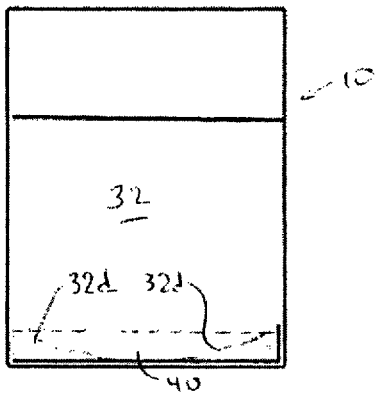

FIG. 11D shows Option D wherein the re-seal adhesive 32 is deadened in two arcuate regions 32*d* located at lower corners of the connecting tab 40, each of the arcuate regions 32*d* having a length about equal to the length of the connecting tab 40 and decreasing in area from the outer edge of the connecting tab to the center of the connecting tab 40.

Figure 11E:
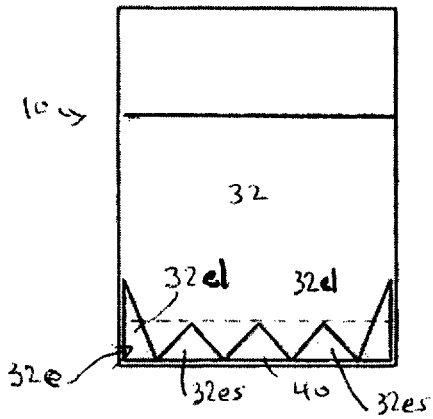

FIG. 11E shows Option E wherein the re-seal adhesive 32 is deadened in a sawtooth pattern of triangular regions 32*fe* extending from the lower edge of the connecting tab 40, the triangular regions 32*e* including two long portions 32*el* and three short portions 32*es*, the long portions 32*el* having a length greater than the length of the connecting tab 40 and decreasing in area in a direction towards the center of the connecting tab 40 and the short portions 32*es* having a length about equal to the length of the connecting tab 40 and increasing in area in a direction towards a bottom edge of the connecting tab 40.

Figure 11F:
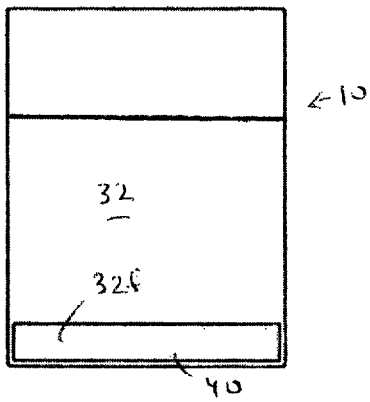
Figure 11G:
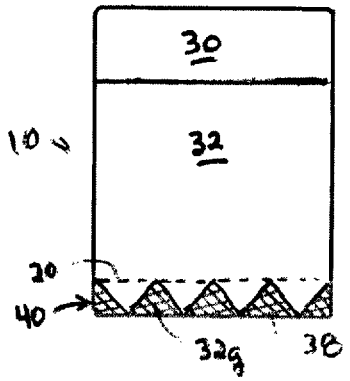
Figure 11H:
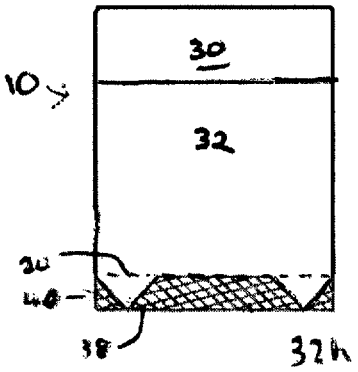

FIG. 11F shows Option F wherein the re-seal adhesive 32 is deadened in a rectangular region 32*f* about the size of the connecting tab 40. FIG. 11G shows Option G wherein the re-seal adhesive 32 is deadened in a sawtooth pattern 32*g* with triangular regions of deadened adhesive extending about 7.5 mm from the bottom edge 38 to the line of weakness 20 forming the connecting tab 40. The sawtooth pattern 32*g* of deadened adhesive can provide four triangular areas of re-seal adhesive 32 which converge at four points spaced apart along the bottom edge by about 12 mm. FIG. 11H shows Option H wherein re-seal adhesive 32 is deadened in a pattern 32*h* which is trapezoidal across the center of the connecting tab 40 and triangular at each end such that two triangular areas of re-seal adhesive which converge at two points along the bottom edge 38, each point spaced about 6.5 mm from a side edge of the pull tab 10.

FIG. 12 shows a pull tab 10 with a large machine readable mark 22 at an upper end of an outer surface of the pull tab 10 and two smaller machine readable marks 24, 26 at opposite corners of the connecting tab 40. As shown, the smaller larks 24, 26 extend from the bottom edge 38 slightly beyond the line of weakness 20.

FIG. 13 shows an underside of a pull tab 10 wherein a line of weakness 21 extends through the permanent adhesive 30 such that the line 21 coincides with the upper corner between the back wall and the top wall of an inner box. The permanent adhesive covers about 30% of the pull tab 10 and the restick adhesive 32 covers the rest of the pull tab. The line of weakness 20 extends through the restick adhesive 32 and forms the connecting tab 40.

FIG. 14 shows the pull tab 10 with the liner 44 attached to the restick adhesive 32 at a location between the lines of weakness 20, 21.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A pull tab configured to close an opening in an inner box for consumer goods, wherein the inner box fits within an outer box including a hinged lid configured to provide access to an inner volume of the outer box, the pull tab comprising:

a rectangular shaped sheet of polymer material including a zone of re-stick adhesive on an underside thereof, the zone of re-stick adhesive configured to releasably adhere to an area of a top wall of the inner box and an area of a front wall of the inner box when the hinged lid is closed;

a paper liner adhered to a central portion of the rectangular shaped sheet of polymer material, the paper liner having an outer periphery inwardly of an outer periphery of the rectangular shaped sheet of polymer material, the outer periphery of the paper liner configured to extend beyond the opening such that the paper liner overlays the opening and portions of the inner box surrounding the opening when the hinged lid is closed; and a line of weakness forming a connecting tab at an end of the rectangular shaped sheet of polymer material, the zone of re-stick adhesive on the underside of the rectangular shaped sheet of polymer material including one or more triangular-shaped areas of re-stick adhesive on an underside of the connecting tab.

2. The pull tab of claim 1, wherein the one or more triangular-shaped areas form a saw tooth pattern.

3. The pull tab of claim 1, wherein the rectangular shaped sheet of polymer material includes rounded corners.

4. The pull tab of claim 1, wherein the line of weakness includes a row of perforations.

5. The pull tab of claim 1, wherein the paper liner comprises a rectangular shaped piece of bundle wrap adhered to the rectangular shaped sheet of polymer material such that a paper side of the bundle wrap is exposed.

6. The pull tab of claim 5, wherein the bundle wrap includes a paper layer and a foil layer, the foil layer between the paper layer and the rectangular shaped sheet of polymer material.

7. The pull tab of claim 5, wherein the rectangular shaped piece of bundle wrap includes rounded corners.

8. The pull tab of claim 1, wherein the paper liner includes a paper layer and a foil layer, the foil layer between the paper layer and the rectangular shaped sheet of polymer material.

9. The pull tab of claim 8, wherein the foil layer is a metal foil.

10. The pull tab of claim 1, wherein the one or more triangular-shaped areas include different-sized triangular-shaped areas.

11. The pull tab of claim 1, wherein the one or more triangular-shaped areas include four triangular-shaped areas.

12. The pull tab of claim 1, further comprising a zone of permanent adhesive on the underside of the rectangular shaped sheet of polymer material at an end of the rectangular shaped sheet of polymer material opposite the end of the connecting tab.

13. The pull tab of claim 12, wherein the zone of permanent adhesive has a rectangular shape.

14. The pull tab of claim 12, wherein the zone of permanent adhesive extends about 30% or less of a length of the pull tab.

15. The pull tab of claim 1, wherein the rectangular shaped sheet of polymer material comprises polyethylene terephthalate (PET).

16. The pull tab of claim 1, wherein the paper liner comprises a piece of paper laminated to metal foil.

17. The pull tab of claim 1, wherein the rectangular shaped sheet of polymer material has a width of about 50 mm and a length of about 65 mm.

18. The pull tab of claim 1, wherein the paper liner is a rectangular shaped sheet with a width of about 34 mm and a length greater than 35 mm.

19. The pull tab of claim 1, wherein the pull tab includes at least two or more machine readable markings.

20. The pull tab of claim 1, wherein the line of weakness includes a line of about 2.5 mm long perforations.

21. The pull tab of claim 1, wherein the line of weakness is located about 8 mm from a lower edge of the pull tab.

22. The pull tab of claim 1, wherein a length of the pull tab is greater than a width of the pull tab.

23. The pull tab of claim 1, further comprising one or more machine readable markings.

24. The pull tab of claim 23, wherein the one or more machine readable markings includes an eyemark across an upper portion of the pull tab.

25. The pull tab of claim 24, wherein the one or more machine readable markings further includes an eyemark at each bottom corner of the pull tab.

26. The pull tab of claim 1, wherein the underside of the connecting tab further includes one or more areas of deadened re-stick adhesive adjacent the one or more triangular-shaped areas of re-stick adhesive.

27. The pull tab of claim 1, wherein the underside of the connecting tab includes one or more triangular-shaped areas of deadened re-stick adhesive between the one or more triangular-shaped areas of re-stick adhesive and a free end of the connecting tab.

28. A pull tab configured to close an opening in a box for consumer goods, the pull tab comprising:

a rectangular shaped sheet of polymer material including a zone of re-stick adhesive on an underside thereof, the zone of re-stick adhesive configured to releasably adhere to an area of a top wall of the box and an area of a front wall of the box;

a paper liner adhered to a central portion of the rectangular shaped sheet of polymer material, the paper liner having an outer periphery inwardly of an outer periphery of the rectangular shaped sheet of polymer material, the outer periphery of the paper liner configured to extend beyond the opening of the box; and a line of weakness forming a connecting tab at an end of the rectangular shaped sheet of polymer material, the zone of re-stick adhesive on the underside of the rectangular shaped sheet of polymer material including one or more triangular-shaped areas of re-stick adhesive on an underside of the connecting tab.

29. The pull tab of claim 28, wherein the underside of the connecting tab further includes one or more areas of deadened re-stick adhesive adjacent the one or more triangular-shaped areas of re-stick adhesive.

30. The pull tab of claim 28, wherein the underside of the connecting tab includes one or more triangular-shaped areas of deadened re-stick adhesive between the one or more triangular-shaped areas of re-stick adhesive and a free end of the connecting tab.

* * * * *